US010850330B2

(12) United States Patent
Ishii et al.

(10) Patent No.: US 10,850,330 B2
(45) Date of Patent: Dec. 1, 2020

(54) PROCESS FOR PRODUCING NICKEL POWDER

(71) Applicant: SUMITOMO METAL MINING CO., LTD., Tokyo (JP)

(72) Inventors: Junji Ishii, Ehime (JP); Hiroyuki Tanaka, Ehime (JP); Shingo Murakami, Ehime (JP); Yuki Kumagai, Ehime (JP); Masaya Yukinobu, Ehime (JP); Yoshiaki Matsumura, Ehime (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 268 days.

(21) Appl. No.: 15/769,521

(22) PCT Filed: Oct. 14, 2016

(86) PCT No.: PCT/JP2016/080603
§ 371 (c)(1),
(2) Date: Apr. 19, 2018

(87) PCT Pub. No.: WO2017/069067
PCT Pub. Date: Apr. 27, 2017

(65) Prior Publication Data

US 2018/0304375 A1 Oct. 25, 2018

(30) Foreign Application Priority Data

Oct. 19, 2015 (JP) ..... 2015-205252

(51) Int. Cl.
*B22F 9/24* (2006.01)
*C22C 19/03* (2006.01)
(Continued)

(52) U.S. Cl.
CPC ..... *B22F 9/24* (2013.01); *B22F 1/0014* (2013.01); *C22C 19/03* (2013.01); *B22F 1/0044* (2013.01);
(Continued)

(58) Field of Classification Search
None
See application file for complete search history.

(56) References Cited

U.S. PATENT DOCUMENTS

2002/0011131 A1* 1/2002 Hosokura ..... B22F 9/24 75/373
2013/0008286 A1* 1/2013 Yamada ..... B22F 9/24 75/345

FOREIGN PATENT DOCUMENTS

JP H04-365806 A 12/1992
JP H11-229006 A 8/1999
(Continued)

OTHER PUBLICATIONS

Englsh Translation of JP 2002/317214 (originally published Oct. 31, 2002) from Espacenet.*
(Continued)

*Primary Examiner* — George Wyszomierski
(74) *Attorney, Agent, or Firm* — Oliff PLC

(57) ABSTRACT

A process for producing nickel powder capable of obtaining inexpensive, and also, high-performance nickel powder, even when using wet process. A process for producing nickel powder, including a crystallization step for obtaining nickel crystal powder by reductive reaction in reaction solution in which at least water-soluble nickel salt, metal salt of metal more noble than nickel, reducing agent, alkali hydroxide, amine compound, and water are mixed, wherein the reducing agent to be mixed in the crystallization step is hydrazine, the amine compound is autolysis inhibitor of hydrazine, and contains two or more primary amino groups in molecule, or
(Continued)

contains one primary amino group and one or more secondary amino groups in molecule, and ratio of molar number of the amine compound with respect to molar number of nickel in the reaction solution is in a range of 0.01 mol % to 5 mol %.

18 Claims, 8 Drawing Sheets

(51) Int. Cl.

| | |
|---|---|
| ***B22F 1/00*** | (2006.01) |
| *B22F 9/00* | (2006.01) |
| *B22F 9/04* | (2006.01) |
| *C22C 1/04* | (2006.01) |

(52) U.S. Cl.
CPC ..... *B22F 1/0088* (2013.01); *B22F 9/002* (2013.01); *B22F 9/04* (2013.01); *B22F 2301/15* (2013.01); *B22F 2304/056* (2013.01); *B22F 2304/058* (2013.01); *B22F 2998/00* (2013.01); *B22F 2998/10* (2013.01); *C22C 1/0433* (2013.01)

(56) References Cited

FOREIGN PATENT DOCUMENTS

| | | | | |
|---|---|---|---|---|
| JP | 2002-53904 | A | | 2/2002 |
| JP | 2002-530521 | A | | 9/2002 |
| JP | 2002/317214 | A | * | 10/2002 |
| JP | 2004-211191 | A | | 7/2004 |
| JP | 2005-97729 | A | | 4/2005 |
| JP | 2015-161025 | A | | 9/2015 |
| WO | 2008/001741 | A1 | | 1/2008 |
| WO | 2012/060776 | A1 | | 5/2012 |

OTHER PUBLICATIONS

Jan. 10, 2017 International Search Report issued in International Patent Application No. PCT/JP2016/080603.

* cited by examiner

PROCESS FOR PRODUCING NICKEL POWDER

BACKGROUND OF THE INVENTION

Field of the Invention

The present invention relates to a process for producing low-cost, high-performance nickel powder used as an electrode of a laminated ceramic component, and especially relates to a process for producing low-cost, high-performance nickel powder obtained by wet process. The present application claims priority based on Japanese Patent Application No. 2015-205252 filed in Japan on Oct. 19, 2015, which is incorporated by reference herein.

Description of Related Art

Nickel powder is used as a material of a capacitor of an electronic circuit, especially as a material of a thick film conductor composing an internal electrode of a laminated ceramic component such as a laminated ceramic capacitor (MLCC: multilayer ceramic capacitor) or a multilayer ceramic substrate.

Recently, enlargement of capacity of the laminated ceramic capacitor has been progressed, and an amount of internal electrode paste used for forming the internal electrode of the laminated ceramic capacitor is increasing significantly. Therefore, as metal powder for internal electrode paste composing the thick film conductor, low-cost base metal such as nickel is mainly used instead of using high-cost noble metal.

In a step for producing the laminated ceramic capacitor, internal electrode paste obtained by kneading nickel powder, binder resin such as ethyl cellulose, and organic solvent such as terpineol is screen printed on a dielectric green sheet. The dielectric green sheet, in which internal electrode paste is printed and dried, is laminated so that internal electrode paste printing layer and the dielectric green sheet will be overlapped alternately, and crimped to obtain a laminated body.

A ceramic green body can be obtained by cutting this laminated body in prescribed size, and then, by removing binder resin by heat treatment (debinding treatment), and further, by calcining this laminated body with high temperature of about 1300° C.

Then, an external electrode is mounted to the obtained ceramic green body, and the laminated ceramic capacitor is obtained. As base metal such as nickel is used as metal powder in internal electrode paste which will be the internal electrode, the debinding treatment of the laminated body is performed under environment in which oxygen concentration is extremely low such as inactive environment, in order to prevent oxidization of base metal.

Along with miniaturization and capacity enlargement of the laminated ceramic capacitor, thinning of both internal electrode and dielectric substance has been progressed. Accordingly, particle size of nickel powder used in internal electrode paste is also progressed to be fine, and nickel powder with average particle size equal to or less than 0.5 μm is required, and especially, use of nickel powder with average particle size equal to or less than 0.3 μm is becoming mainstream.

When roughly classified, there are vapor phase process and wet process in a process for producing nickel powder. As vapor phase process, for example, there are a process for producing nickel powder by reducing nickel chloride vapor by hydrogen described in Patent Document 1, and a process for producing nickel powder by vaporizing nickel metal in plasma described in Patent Document 2. In addition, as wet process, for example, there is a process for producing nickel powder by adding a reducing agent to nickel salt solution described in Patent Document 3.

Vapor phase process is effective measures for obtaining high-performance nickel powder excellent in crystallinity as it is high temperature process more than about 1000° C., but there is a problem that particle size of the obtained nickel powder will be wide. As mentioned above, in thinning of the internal electrode, nickel powder with relatively narrow particle size with average particle size equal to or less than 0.5 μm, and without coarse particles, is required, so classification treatment by introducing expensive classification device will be necessary, in order to obtain such nickel powder by vapor phase process.

In addition, in classification treatment, it is possible to remove coarse particles larger than classification point, with the aim of classification point of optional value of about 0.6 to 2 μm, but a part of particles smaller than the classification point is also removed simultaneously, there is a problem that actual income of product will be decreased significantly. Therefore, by vapor phase process, increase in cost of the product is inevitable, including the introduction of above expensive equipment.

Further, by vapor phase process, when using nickel powder with average particle size equal to or less than 0.2 μm, especially equal to or less than 0.1 μm, removal of coarse particles by classification treatment itself becomes difficult, so it is not possible to correspond to further thinning of the internal electrode in the future.

On the other hand, wet process is having an advantage that particle size of the obtained nickel powder is narrow, compared to vapor phase process. Especially, in a process for producing nickel powder by adding solution containing hydrazine to solution containing nickel salt and copper salt as reducing agent described in Patent Document 3, under coexistence with metal salt (nucleating agent) of metal more noble than nickel, nickel salt (accurately, nickel ion ($Ni^{2+}$), or nickel complex ion) is reduced by hydrazine, so number of nucleation will be controlled (in other words, particle size is controlled), and also, nucleation and particle growth will be uniform, and it is known that fine nickel powder with narrower particle size distribution can be obtained.

Patent Document 1: Japanese Patent Application Laid-Open No. H4-365806

Patent Document 2: Japanese Patent Application Publication No. 2002-530521

Patent Document 3: Japanese Patent Application Laid-Open No. 2002-53904

SUMMARY OF THE INVENTION

However, it is understood that hydrazine used as reducing agent in wet process described in Patent Document 3 is not only consumed for reduction of the above nickel salt to nickel powder, but also consumed for autolysis (hydrazine→nitrogen+ammonia) with activated surface of nickel powder immediately after reduction as catalyst. Further, consumption of hydrazine by this autolysis is two times or more of consumption of hydrazine by reduction, so consumption of hydrazine, which accounts for large portion in cost of medicament in wet process, was being excessive significantly compared to theoretical necessary amount (0.5 mol of hydrazine for 1 mol of nickel) for proper reductive reaction.

Therefore, nickel powder obtained by wet process (wet nickel powder) is required to reduce cost further, in order to secure cost advantage with respect to nickel powder by vapor phase process (vapor phase nickel powder), but there were problems that high cost of medicament by excessive consumption of hydrazine will be increased, and cost for treatment of nitrogen-containing waist liquid containing high concentration of ammonia generated by autolysis will be increased.

Here, the purpose of the present invention is to provide a process for producing nickel powder capable of obtaining low-cost, high performance nickel powder, even when wet process is used.

The inventors have found that in a crystallization step of a process for producing nickel powder by wet process, in other words, in a step for performing series of reductive reaction (crystallization reaction) in reaction solution from initial nucleation to particle growth, infinitesimal amount of specific amine compound functions extremely effective as autolysis inhibitor of hydrazine used as reducing agent. In addition, the inventors have found that the specific amine compound also functions as complexing agent forming nickel ion ($Ni^{2+}$) and complex ion, in other words, as accelerator of reductive reaction, and also, functions as coupling inhibitor which tends to prevent formation of coarse particles generated by coupling of nickel particles themselves during crystallization. The present invention was completed based on the above findings.

In other words, one embodiment of the present invention is a process for producing nickel powder, comprising a crystallization step for obtaining nickel crystal powder by reductive reaction in reaction solution in which at least water-soluble nickel salt, metal salt of metal more noble than nickel, reducing agent, alkali hydroxide, amine compound, and water are mixed, wherein the reducing agent to be mixed in the crystallization step is hydrazine ($N_2H_4$), the amine compound is autolysis inhibitor of hydrazine, and contains two or more primary amino groups (—$NH_2$) in molecule, or contains one primary amino group (—$NH_2$) and one or more secondary amino groups (—NH—) in molecule, and ratio of molar number of the amine compound with respect to molar number of nickel in the reaction solution is in a range of 0.01 mol % to 5 mol %.

At this time, in one embodiment of the present invention, the amine compound may be at least any of alkylene amine or alkylene amine derivative.

Also, in one embodiment of the present invention, alkylene amine or alkylene amine derivative may be at least having a structure of following formula A, in which nitrogen atoms of amino group in molecule are bonded via carbon chain with two carbons.

A

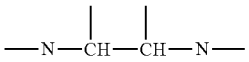

Further, at this time, in one embodiment of the present invention, alkylene amine may be one or more selected from ethylene diamine ($H_2NC_2H_4NH_2$), diethylene triamine ($H_2NC_2H_4NHC_2H_4NH_2$), triethylene tetramine ($H_2N(C_2H_4NH)_2C_2H_4NH_2$), tetraethylene pentamine ($H_2N(C_2H_4NH)_3C_2H_4NH_2$), pentaethylen hexamine ($H_2N(C_2H_4NH)_4C_2H_4NH_2$), propylene diamine ($CH_3CH(NH_2)CH_2NH_2$), and alkylene amine derivative may be one or more selected from tris (2-aminoethyl) amine ($N(C_2H_4NH_2)_3$), N-(2-aminoethyl) ethanol amine ($H_2NC_2H_4NHC_2H_4OH$), N-(2-aminoethyl) propanol amine ($H_2NC_2H_4NHC_3H_6OH$), 2, 3-diaminopropionic acid ($H_2NCH_2CH(NH)COOH$), and 1, 2-cyclohexane diamine ($H_2NC_6H_{10}NH_2$).

In addition, in one embodiment of the present invention, sulfide compound as autolysis inhibition adjuvant of the hydrazine is blended in the reaction solution, and the sulfide compound contains one or more sulfide group (—S—) in molecule, and ratio of molar number of the sulfide compound with respect to molar number of the nickel in the reaction solution may be in a range of 0.01 mol % to 5 mol %.

Also, in one embodiment of the present invention, the sulfide compound may be carboxy group-containing sulfide compound or hydroxyl group-containing sulfide compound further containing at least one or more carboxy group (—COOH) or hydroxyl group (—OH) in molecule.

In addition, in one embodiment of the present invention, carboxy group-containing sulfide compound or hydroxyl group-containing sulfide compound may be one or more selected from methionine ($CH_3SC_2H_4CH(NH_2)COOH$), ethionine ($C_2H_5SC_2H_4CH(NH_2)COOH$), thiodipropionic acid ($HOOCC_2H_4SC_2H_4COOH$), thiodiglycolic acid ($HOOCCH_2SCH_2COOH$), and thiodiglycol ($HOC_2HSC_2H_5OH$).

Also, in one embodiment of the present invention, ratio of used amount of molar number of the hydrazine with respect to molar number of the nickel may be less than 2.0, in the crystallization step.

In addition, in one embodiment of the present invention, ratio of used amount of molar number of the hydrazine with respect to molar number of the nickel may be less than 1.3.

Also, in one embodiment of the present invention, water-soluble nickel salt may be one or more selected from nickel chloride ($NiCl_2$), nickel sulfate ($NiSO_4$), and nickel nitrate ($Ni(NO_3)_2$).

In addition, in one embodiment of the present invention, metal salt of metal more noble than nickel may be one or more selected from copper salt, gold salt, silver salt, platinum salts, palladium salt, rhodium salt, and iridium salt.

Also, in one embodiment of the present invention, alkali hydroxide may be one or more selected from sodium hydroxide (NaOH) and potassium hydroxide (KOH).

In one embodiment of the present invention, in the crystallization step, nickel salt solution in which at least the water soluble nickel salt and the metal salt of metal more noble than nickel are dissolved in water, and reducing agent solution containing at least the reducing agent, the alkali hydroxide and water, are prepared, and after adding the amine compound as autolysis inhibitor of hydrazine to at least one of the nickel salt solution and the reducing agent solution, and further, after adding the sulfide compound as autolysis inhibition adjuvant of hydrazine to at least one of the nickel salt solution and the reducing agent solution according to need, the nickel salt solution is added and mixed to the reducing agent solution, or vice versa, the reducing agent solution is added and mixed to the nickel salt solution.

Alternatively, in one embodiment of the present invention, in the crystallization step, nickel salt solution in which at least the water soluble nickel salt and the metal salt of metal more noble than nickel are dissolved in water, and reducing agent solution containing at least the reducing agent, the alkali hydroxide and water, are prepared, and after adding and mixing the nickel salt solution to the reducing agent solution, or vice versa, after adding and mixing the reducing agent solution to the nickel salt solution, the amine compound as autolysis inhibitor of hydrazine is added and mixed, and further, the sulfide compound as autolysis inhibition adjuvant of hydrazine is added and mixed according to need.

Alternatively, in one embodiment of the present invention, in the crystallization step, nickel salt solution in which at least the water soluble nickel salt and the metal salt of metal more noble than nickel are dissolved in water, and reducing agent solution containing at least the reducing agent, the alkali hydroxide and water, are prepared, and after adding the sulfide compound as autolysis inhibition adjuvant of hydrazine to at least one of the nickel salt solution and the reducing agent solution according to need, the nickel salt solution is added and mixed to the reducing agent solution, or vice versa, the reducing agent solution is added and mixed to the nickel salt solution, and then, the amine compound as autolysis inhibitor of hydrazine is added and mixed.

Alternatively, in one embodiment of the present invention, in the crystallization step, nickel salt solution in which at least the water soluble nickel salt and the metal salt of metal more noble than nickel are dissolved in water, reducing agent solution containing at least the reducing agent and water, and alkali hydroxide solution containing at least the alkali hydroxide and water, are prepared, and after adding the amine compound as autolysis inhibitor of hydrazine to at least one of the nickel salt solution, the reducing agent solution and the alkali hydroxide solution, and further, after adding the sulfide compound as autolysis inhibition adjuvant of hydrazine to at least one of the nickel salt solution, the reducing agent solution and the alkali hydroxide solution according to need, the nickel salt solution and the reducing agent solution are mixed to obtain nickel salt/reducing agent-containing solution, and further, the alkali hydroxide solution is added and mixed to the nickel salt/reducing agent-containing solution.

Alternatively, in one embodiment of the present invention, in the crystallization step, nickel salt solution in which at least the water soluble nickel salt and the metal salt of metal more noble than nickel are dissolved in water, reducing agent solution containing at least the reducing agent and water, and alkali hydroxide solution containing at least the alkali hydroxide and water, are prepared, and after obtaining nickel salt/reducing agent-containing solution by mixing the nickel salt solution and the reducing agent solution, and further, after adding and mixing the alkali hydroxide solution to the nickel salt/reducing agent-containing solution, the amine compound as autolysis inhibitor of hydrazine is added and mixed, and further, the sulfide compound as autolysis inhibition adjuvant of hydrazine is added and mixed according to need.

Alternatively, in one embodiment of the present invention, in the crystallization step, nickel salt solution in which at least the water soluble nickel salt and the metal salt of metal more noble than nickel are dissolved in water, reducing agent solution containing at least the reducing agent and water, and alkali hydroxide solution containing at least the alkali hydroxide and water, are prepared, and after adding the sulfide compound as autolysis inhibition adjuvant of hydrazine to at least one of the nickel salt solution, the reducing agent solution and the alkali hydroxide solution according to need, the nickel salt solution and the reducing agent solution are mixed to obtain nickel salt/reducing agent-containing solution, and further, after adding and mixing the alkali hydroxide solution to the nickel salt/reducing agent-containing solution, the amine compound as autolysis inhibitor of hydrazine is added and mixed.

In addition, in one embodiment of the present invention, in the crystallization step, temperature of the reaction solution when starting reductive reaction (reaction starting temperature) may be 40° C. to 90° C.

The process for producing nickel powder relating to one embodiment of the present invention inhibits autolysis reaction of hydrazine significantly by using infinitesimal amount of specific amine compound or specific amine compound and sulfide compound as autolysis inhibitor of hydrazine, even if it is a process for producing nickel powder by wet process using hydrazine as reducing agent. Therefore, it is possible to reduce used amount of hydrazine significantly, and also, the specific amine compound promotes the reaction as reducing agent, and functions as coupling inhibitor which prevents formation of coarse particles generated by coupling of nickel particles themselves, so it is possible to produce high-performance nickel powder suitable for the internal electrode of the laminated ceramic capacitor inexpensively.

DETAILED DESCRIPTION OF THE INVENTION

Figure 1:
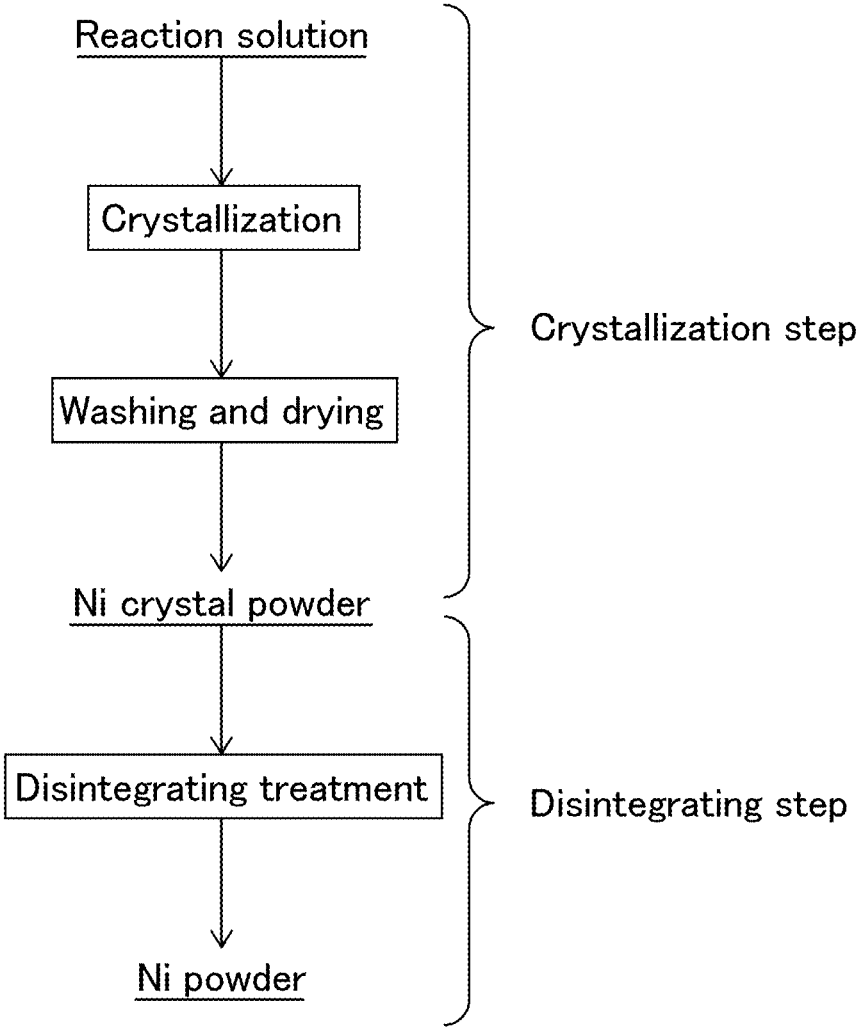
FIG. 1 is a schematic diagram illustrating an example of producing steps in a process for producing nickel powder relating to one embodiment of the present invention.

Hereinafter, explaining in detail about a process for producing nickel powder relating to one embodiment of the present invention in following orders, by referring to the drawings. In addition, the present invention should not be limited by the following examples, and the present invention can be modified optionally without departing from a gist of the present invention.

1. Process for producing nickel powder
   - 1-1. Crystallization step
     - 1-1-1. Medicaments used in the crystallization step
     - 1-1-2. Procedures of crystallization reaction (crystallization procedure)

1-1-3. Crystallization reaction (reductive reaction, hydrazine autolysis reaction)

1-1-4. Crystallization condition (reaction starting temperature)

1-1-5. Collection of nickel crystal powder 1-2. Disintegrating step (post-treatment step)

2. Nickel powder

<1. Process for Producing Nickel Powder>

At first, explaining about a process for producing nickel powder relating to one embodiment of the present invention. FIG. 1 is a schematic diagram illustrating an example of producing steps in a process for producing nickel powder relating to one embodiment of the present invention. The process for producing nickel powder relating to one embodiment mainly comprises a crystallization step for obtaining nickel crystal powder with reductive reaction by hydrazine, in reaction solution containing water soluble nickel salt, metal salt of metal more noble than nickel, hydrazine as reducing agent, alkali hydroxide as pH conditioner and water, and may be added with a disintegrating step performed according to need as post-treatment step. Here, in conventional producing process, widely and generally used complexing agent such as tartaric acid or citric acid is blended as accelerator of reductive reaction in reaction solution, on the other hand, in the process for producing nickel powder relating to one embodiment of the present invention, amine compound containing two or more primary amino groups (—$NH_2$) in molecule, or containing one primary amino group (—$NH_2$) and one or more secondary amino groups (—NH—) in molecule is blended in reaction solution, and the amine compound functions as autolysis inhibitor of hydrazine, accelerator of reductive reaction (complexing agent), and coupling inhibitor.

Nickel crystal powder generated in reductive reaction may be separated from the reaction solution using publicly known procedures, and nickel powder (nickel crystal powder) can be obtained, for example, by using procedures of washing, solid-liquid separation, and drying. In addition, if desired, nickel powder (nickel crystal powder) may be obtained by applying surface treatment (sulfur coating treatment) for modifying surface of nickel crystal powder with sulfur component, by adding sulfur compound such as mercapto compound (compound containing mercapto group (—SH)) or disulfide compound (compound containing disulfide group (—S—S—)) to reaction solution containing nickel crystal powder or to washing liquid. In addition, in reaction with nickel crystal powder, disulfide group (—S—S—) will be chemically bound directly (Ni—S—) with surface of nickel crystal powder as binding between two sulfur atoms will be separated, so sulfur coating treatment is possible as well as mercapto group (—SH), and disulfide group (—S—S—) differs significantly from sulfide group (—S—), which adsorbs to surface of nickel crystal powder but does not chemically bind directly to surface of nickel crystal powder. In addition, it is possible to obtain nickel powder by applying heat treatment to the obtained nickel powder (nickel crystal powder) at a temperature of about 200° C. to 300° C., for example in inactive atmosphere or reductive atmosphere. These sulfur coating treatment and heat treatment are able to control sintering behavior of nickel powder and debinding behavior in an internal electrode when producing a laminated ceramic capacitor, so it is significantly effective when used in appropriate scope.

Also, according to need, it is preferable to obtain nickel powder to reduce coarse particles by coupling of nickel particles generated at nickel particle generating step of the crystallization step, by adding a disintegrating step (post-treatment step) for applying disintegrating treatment to nickel powder (nickel crystal powder) obtained in the crystallization step.

In the process for producing nickel powder relating to one embodiment of the present invention, by adding specific amine compound in prescribed rate, autolysis reaction of hydrazine as reducing agent is significantly inhibited, and reductive reaction is accelerated, and also, formation of coarse particles generated by coupling of nickel particles themselves is inhibited, so it is possible to produce high-performance nickel powder suitable for the internal electrode of the laminated ceramic capacitor inexpensively. Hereinafter, explaining about a detail of the process for producing nickel powder relating to one embodiment of the present invention, in order of crystallization step to disintegrating step.

(1-1. Crystallization Step)

In a crystallization step, nickel crystal powder is obtained while significantly inhibiting autolysis of hydrazine by a function of infinitesimal amount of specific amine compound, and at the same time, by reducing nickel salt (precisely, nickel ion or nickel complex ion) with hydrazine in reaction solution, in which at least water soluble nickel salt, metal salt of metal more noble than nickel, reducing agent, alkali hydroxide, amine compound and water are mixed.

(1-1-1. Medicaments Used in Crystallization Step)

In the crystallization step relating to one embodiment of the present invention, the reaction solution containing water and various medicaments such as nickel salt, metal salt of metal more noble than nickel, reducing agent, alkali hydroxide and amine compound, is used. Water as solvent is preferably with high purity such as ultrapure water (conductivity: ≤0.06 μS/cm (microsiemens per centimeter)) and pure water (conductivity: ≤1 μS/cm), from a point of view of reducing amount of impurities in obtained nickel powder, and especially, it is preferable to use inexpensive and easily available pure water. Hereinafter, describing about various medicaments respectively.

(a) Nickel Salt

Nickel salt used in the process for producing nickel powder relating to one embodiment of the present invention is not limited especially, as long as it is nickel salt easily soluble to water, and it is possible to use one or more selected from nickel chloride, nickel sulfate and nickel nitrate. Among these nickel salts, nickel chloride, nickel sulfate or mixture thereof is more preferable.

(b) Metal Salt of Metal More Noble than Nickel

By containing metal more noble than nickel in nickel salt solution, metal more noble than nickel will be reduced at first, when reducing and precipitating nickel, and functions as nucleating agent, which will be initial nucleus, and it is possible to produce fine nickel crystal powder (nickel powder) by particle growth of this initial nucleus.

As metal salt of metal more noble than nickel, water-soluble noble metal salt such as water-soluble copper salt, gold salt, silver salt, platinum salts, palladium salt, rhodium salt and iridium salt can be cited. For example, it is possible to use copper sulfate as water-soluble copper salt, silver nitrate as water-soluble silver salt, and palladium chloride (II) sodium, palladium chloride (II) ammonium, palladium nitrate (II), palladium sulfate (II) and else as water-soluble palladium salt, but it is not limited to these compounds.

As metal salt of metal more noble than nickel, it is especially preferable to use the above palladium salt, as it is possible to control particle size of obtained nickel powder to be more fine, although particle size distribution will be little wide. A ratio of nickel and palladium salt [molar ppm]

(molar number of palladium salt/molar number of nickel× $10^6$) when using palladium salt depends on aimed average particle size of nickel powder, but for example, when average particle size is 0.05 μm to 0.5 μm, it may be in a range of 0.2 molar ppm to 100 molar ppm, preferably in a range of 0.5 molar ppm to 25 molar ppm. When the above ratio is less than 0.2 molar ppm, average particle size will be more than 0.5 μm, on the other hand, when the above ratio is more than 100 molar ppm, expensive palladium salt will be used a lot, and it will lead to increase of cost of nickel powder.

(c) Reducing Agent

In the process for producing nickel powder relating to one embodiment of the present invention, hydrazine ($N_2H_4$, molecular weight: 32.05) is used as reducing agent. In addition, in hydrazine, there is hydrazine hydrate ($N_2H_4.H_2O$, molecular weight: 50.06) other than anhydrous hydrazine, but either may be used. Reductive reaction of hydrazine is as indicated in following formula (2), but it is having characteristics that reduction power is high (especially in alkalinity), no byproducts of reductive reaction will be generated in reaction solution (nitrogen gas and water), there is few impurities, and it is easily available, so it is suitable for reducing agent, and for example, commercially available industrial grade 60 mass % hydrazine hydrate can be used.

(d) Alkali Hydroxide

Reduction power of hydrazine becomes stronger as alkalinity of reaction solution is stronger (refer to following formula (2)), so in the process for producing nickel powder relating to one embodiment of the present invention, alkali hydroxide is used as pH conditioner which improves alkalinity. Alkali hydroxide is not limited especially, but it is preferable to use alkali metal hydroxide from aspects of cost and easiness of availability, and concretely, it is preferable to be one or more selected from sodium hydroxide and potassium hydroxide.

Blending quantity of alkali hydroxide is such that pH of reaction solution in reaction temperature will be 9.5 or more, preferably 10 or more, more preferably 10.5 or more, so that reduction power of hydrazine as reducing agent will be improved sufficiently. (For example in temperatures of about 25° C. and 70° C., pH of reaction solution will be smaller in high temperature of 70° C.)

(e) Amine Compound (Autolysis Inhibitor of Hydrazine)

Amine compound used in the process for producing nickel powder relating to one embodiment of the present invention is having functions of autolysis inhibitor of hydrazine, accelerator of reductive reaction, and coupling inhibitor of nickel particles themselves, and it is a compound containing two or more primary amino groups (—$NH_2$) in molecule, or containing one primary amino group (—$NH_2$) and one or more secondary amino groups (—NH—) in molecule.

Amine compound is at least any of alkylene amine or alkylene amine derivative, and it is preferable that it is at least having a structure of following formula A, in which nitrogen atoms of amino group in molecule are bonded via carbon chain with two carbons.

A

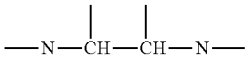

The examples of the alkylene amine and alkylene amine derivative are indicated in following formulas B to L concretely, but alkylene amine is one or more selected from ethylene diamine (EDA) ($H_2NC_2H_4NH_2$), diethylene triamine (DETA) ($H_2NC_2H_4NHC_2H_4NH_2$), triethylene tetramine (TETA) ($H_2N(C_2H_4NH)_2C_2H_4NH_2$), tetraethylene pentamine (TEPA) ($H_2N(C_2H_4NH)_3C_2H_4NH_2$), pentaethylen hexamine (PEHA) ($H_2N(C_2H_4NH)_4C_2H_4NH_2$), propylene diamine (1, 2-diaminopropane, 1, 2-propanediamine) (PDA) ($CH_3CH(NH_2)CH_2NH_2$), and alkylene amine derivative is one or more selected from tris (2-aminoethyl) amine (TAEA) ($N(C_2H_4NH_2)_3$), N-(2-aminoethyl) ethanolamine (2-(2-aminoethyl amino) ethanol) (AEEA) ($H_2NC_2H_4NHC_2H_4OH$), N-(2-aminoethyl) propanol amine (2-(2-aminoethyl amino) propanol) (AEPA) ($H_2NC_2H_4NHC_3H_6OH$), L(or D, DL)-2, 3-diaminopropionic acid (3-amino-L(or D, DL)-alanine) (DAPA) ($H_2NCH_2CH(NH)COOH$), and 1, 2-cyclohexane diamine (1, 2-diaminocyclohexane) (CHDA) ($H_2NC_6H_{10}NH_2$). These alkylene amine and alkylene amine derivative are soluble to water, and especially, ethylene diamine and diethylene triamine are preferable as function to inhibit autolysis of hydrazine is relatively strong, and also, they are easily available and inexpensive.

Formula B

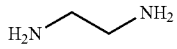

(EDA)

Formula C

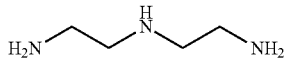

(DETA)

Formula D

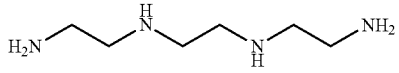

(TETA)

Formula E

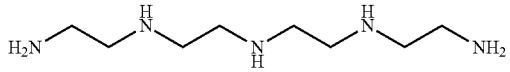

(TEPA)

Formula F

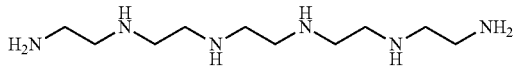

(PEHA)

Formula G

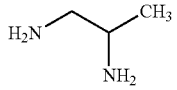

(PDA)

Formula H

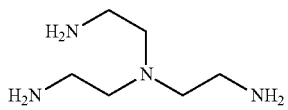

(TAEA)

-continued

Formula I

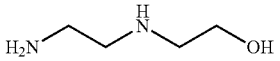

(AEEA)

Formula J

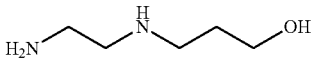

(AEPA)

Formula K

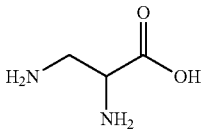

(DAPA)

Formula L

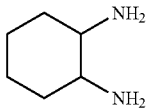

(CHDA)

Function of the amine compound as accelerator of reductive reaction is considered to be according to ability as complexing agent for forming nickel complex ion by complexing nickel ion ($Ni^{2+}$) in reaction solution, but about functions as autolysis inhibitor of hydrazine and as coupling inhibitor of nickel particles themselves, detailed mechanism of action is not clarified yet. However, it is possible to presume as follows. In other words, among amino groups in amine compound molecule, especially primary amino group (—$NH_2$) and secondary amino group (—NH—) adsorb firmly to surface of nickel crystal powder in reaction solution, and amine compound covers and protects nickel crystal powder, so it prevents excessive contact between hydrazine molecule and nickel crystal powder, and also, prevents coupling of nickel crystal powder themselves, thus causing onset of each function to inhibit autolysis of hydrazine and to inhibit coupling of nickel particles themselves.

In addition, it is preferable that alkylene amine or alkylene amine derivative which is amine compound is having a structure of formula A, in which nitrogen atoms of amino group in molecule are bonded via carbon chain with two carbons, but as its reason, it is considered that, when nitrogen atoms of amino group which adsorb firmly to nickel crystal powder are bonded via carbon chain with three or more carbons, degree of freedom of movement of carbon chain portion of amine compound molecule (flexibility of molecule) becomes larger as carbon chain becomes longer, so it will not be possible to effectively prevent contact of hydrazine molecule to nickel crystal powder.

A

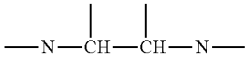

Actually, compared to ethylene diamine of the formula B (EDA) ($H_2NC_2H_4NH_2$) or propylene diamine of the formula G (1, 2-diaminopropane, 1, 2-propanediamine) (PDA) ($CH_3CH(NH_2)CH_2NH_2$) in which nitrogen atoms of amino group in molecule are bonded via carbon chain with two carbons, it is confirmed that trimethylene diamine of following formula M (1, 3-diaminopropane, 1, 3-propanediamine) (TMDA) ($H_2NC_2H_4NH_2$) in which nitrogen atoms of amino group in molecule are bonded via carbon chain with three or more carbons is inferior in function to inhibit autolysis of hydrazine.

Formula M

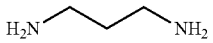

(TMDA)

Here, ratio [mol %] of molar number of the amine compound with respect to molar number of nickel in the reaction solution (molar number of amine compound/molar number of nickel×100) is in a range of 0.01 mol % to 5 mol %, preferably in a range of 0.03 mol % to 2 mol %. When the ratio is less than 0.01 mol %, the amine compound will be too little, so each function to inhibit autolysis of hydrazine, to accelerate reductive reaction, and to inhibit coupling of nickel particles themselves cannot be achieved. On the other hand, when the ratio is more than 5 mol %, as a result of ability as complexing agent for forming nickel complex ion becomes too strong, characteristic deterioration of nickel powder occurs, for example, granularity and sphericity of nickel powder will be lost by causing abnormality to particle growth and nickel powder becomes irregular shape, and many coarse particles in which nickel particles themselves are coupled to each other will be formed.

(f) Sulfide Compound (Autolysis Inhibition Adjuvant of Hydrazine)

Sulfide compound used in the process for producing nickel powder relating to one embodiment of the present invention differs from the amine compound, and function to inhibit autolysis of hydrazine is not so high when it is used solely, but when it is used together with the amine compound, it is having a function of autolysis inhibition adjuvant of hydrazine which can improve function to inhibit autolysis of hydrazine significantly, and it is a compound containing one or more sulfide group (—S—) in molecule. In addition, the sulfide compound is also having a function as coupling inhibitor of nickel particles themselves, in addition to the function of autolysis inhibition adjuvant of hydrazine, so when it is used together with the amine compound, it is possible to effectively reduce formation of coarse particles in which nickel particles themselves are coupled to each other.

The sulfide compound is carboxy group-containing sulfide compound or hydroxyl group-containing sulfide compound further containing at least one or more carboxy group (—COOH) or hydroxyl group (—OH) in molecule, and concretely, it is one or more selected from L(or D, DL)-methionine ($CH_3SC_2H_4CH(NH_2)COOH$), L(or D, DL)-ethionine ($C_2H_5SC_2H_4CH(NH_2)COOH$), thiodipropionic acid (3, 3'-thiodipropionic acid) ($HOOCC_2H_4SC_2H_4COOH$), thiodiglycolic acid (2, 2'-thiodiglycolic acid, 2, 2'-thiodiacetic acid, 2, 2'-thiobisacetic acid, mercaptodiacetic acid) ($HOOCCH_2SCH_2COOH$), and thiodiglycol (2, 2'-thiodiethanol) ($HOC_2H_5SC_2H_5OH$). These carboxy group-containing sulfide compound and hydroxyl group-containing sulfide compound are soluble to water, and especially, methionine and thiodiglycolic acid are preferable as they are excellent in function of autolysis inhibition adjuvant of hydrazine, and also, they are easily available and inexpensive.

About function of the sulfide compound as autolysis inhibition adjuvant of hydrazine and coupling inhibitor of nickel particles themselves, detailed mechanism of action is not clarified yet, but it can be presumed as below. In other words, in sulfide compound, sulfide group (—S—) in molecule adsorbs to nickel surface of nickel particles by intermolecular force, but function to cover and protect nickel crystal powder will not be large as the amine compound molecule by itself. On the other hand, if amine compound and sulfide compound are used together, when amine compound molecules adsorb firmly to surface of nickel crystal powder to cover and protect the surface of nickel crystal powder, there is a high possibility that fine regions which cannot be covered completely by amine compound molecules themselves will be formed, but by supplementally covering these regions by adsorption of sulfide compound molecules, contact between nickel crystal powder and hydrazine molecules in reaction solution is prevented more effectively, and further, coupling of nickel crystal powder themselves can be prevented more strongly, thus it can be said that the functions are onset.

Here, ratio [mol %] of molar number of the sulfide compound with respect to molar number of nickel in the reaction solution (molar number of sulfide compound/molar number of nickel×100) is in a range of 0.01 mol % to 5 mol %, preferably in a range of 0.03 mol % to 2 mol %, more preferably in a range of 0.05 mol % to 1 mol %. When the ratio is less than 0.01 mol %, the sulfide compound will be too little, so each function as autolysis inhibition adjuvant of hydrazine and as coupling inhibitor of nickel particles themselves cannot be achieved. On the other hand, even when the ratio is more than 5 mol %, the each function will not be improved, so simply a used amount of sulfide compound will only be increased, and cost of medicament will be increased, at the same time, chemical oxygen demand (COD) of reaction waste liquid in crystallization step will be increased as blending quantity of organic component in reaction solution is increased, so cost for treating waste liquid will be increased.

(g) Other Inclusion

In reaction solution of crystallization step, if it is in a range that increase in cost of medicament will not be a problem, and that it will not hinder each function to inhibit autolysis of hydrazine, to accelerate reductive reaction, and to inhibit coupling of nickel particles themselves of amine compound used in the process for producing nickel powder relating to one embodiment of the present invention, it is possible to contain a little amount of each additive, such as dispersing agent, complexing agent and defoaming agent, in addition to the above-mentioned nickel salt, metal salt of metal more noble than nickel, reducing agent (hydrazine), alkali hydroxide, and amine compound. If appropriate amount of appropriate dispersing agent or complexing agent is used, there is a case that granularity (sphericity) or particle surface smoothness of nickel crystal powder can be improved, and that coarse particles can be reduced. In addition, if appropriate amount of appropriate defoaming agent is used, it will be possible to inhibit foaming in crystallization step caused by nitrogen gas (refer to following formulas (2) to (4)) generated in crystallization reaction. Border line between dispersing agent and complexing agent is obscure, but as dispersing agent, publicly known substances can be used, and for example, alanine ($CH_3CH(COOH)NH_2$), glycine ($H_2NCH_2COOH$), triethanol amine ($N(C_2H_4OH)_3$, diethanol amine (iminodiethanol) ($NH(C_2H_4OH)_2$) can be cited. As complexing agent, publicly known substances can be used, and hydroxy carboxylic acid, carboxylic acid (organic acid containing at least one carboxyl group), hydroxy carboxylate or hydroxy carboxylic acid derivative, carboxylate or carboxylic acid derivative, concretely, tartaric acid, citric acid, malic acid, ascorbic acid, formic acid, acetic acid, pyruvic acid, and these salts or derivatives can be cited.

(1-1-2. Procedure of Crystallization Reaction (Crystallization Procedure))

FIGS. 2 to 7 are drawings to explain crystallization procedure in crystallization step of the process for producing nickel powder relating to one embodiment of the present invention, and the crystallization procedure can be classified roughly into the following first embodiment to sixth embodiment.

Figure 2:
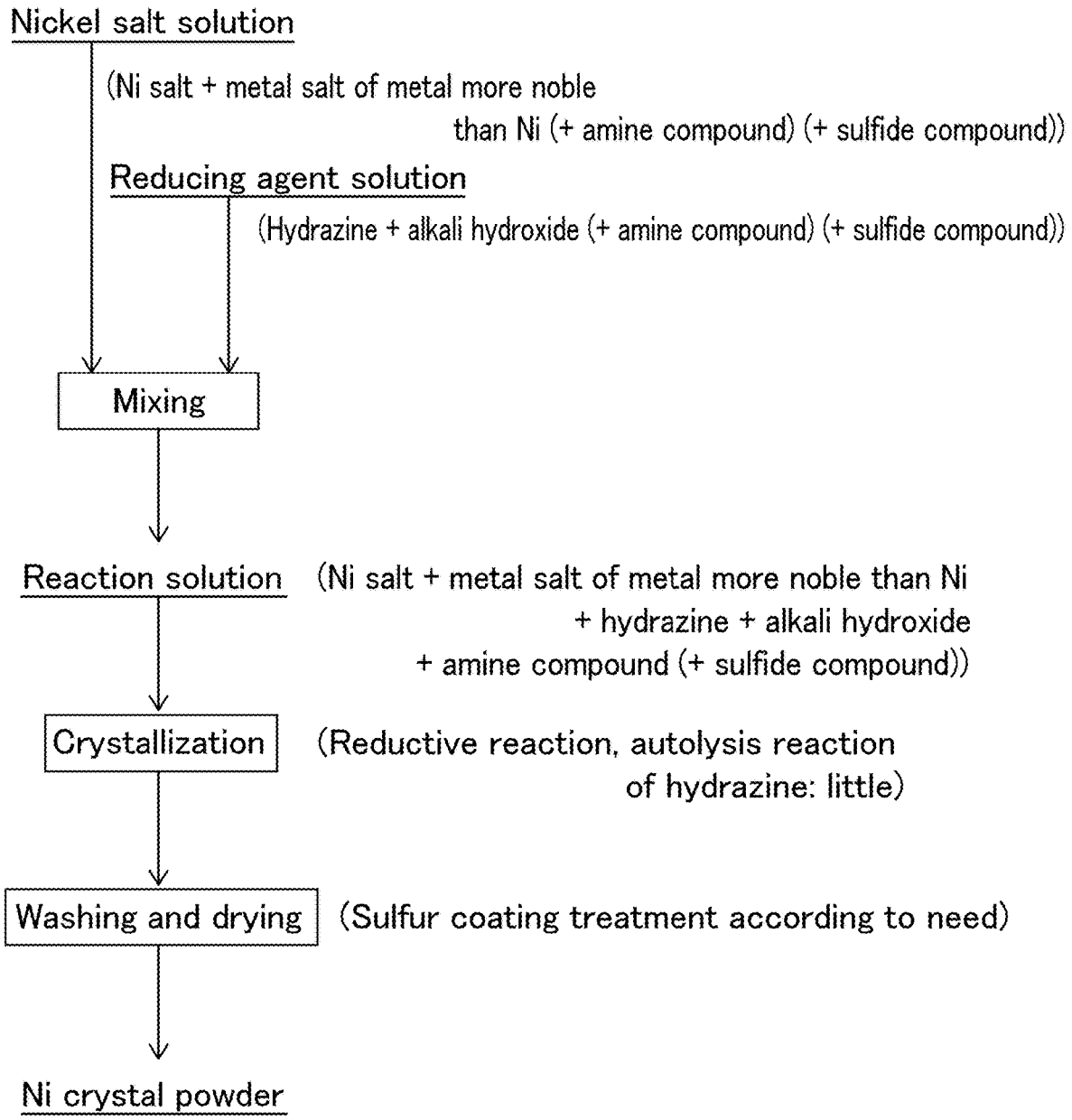
FIG. 2 is a schematic diagram illustrating crystallization procedures relating to first embodiment of a crystallization step in the process for producing nickel powder relating to one embodiment of the present invention.

As illustrated in FIG. 2, in crystallization procedure relating to first embodiment, nickel salt solution, in which at least water-soluble nickel salt and metal salt of metal more noble than nickel are dissolved in water, and reducing agent solution containing at least reducing agent, alkali hydroxide and water are prepared, and after adding amine compound as autolysis inhibitor of hydrazine to at least either of nickel salt solution or reducing agent solution, and further, according to need, after adding sulfide compound as autolysis inhibition adjuvant of hydrazine to at least either of nickel salt solution or reducing agent solution, nickel salt solution is added to and mixed with reducing agent solution, or vis versa, reducing agent solution is added to and mixed with nickel salt solution to perform crystallization reaction.

Figure 3:
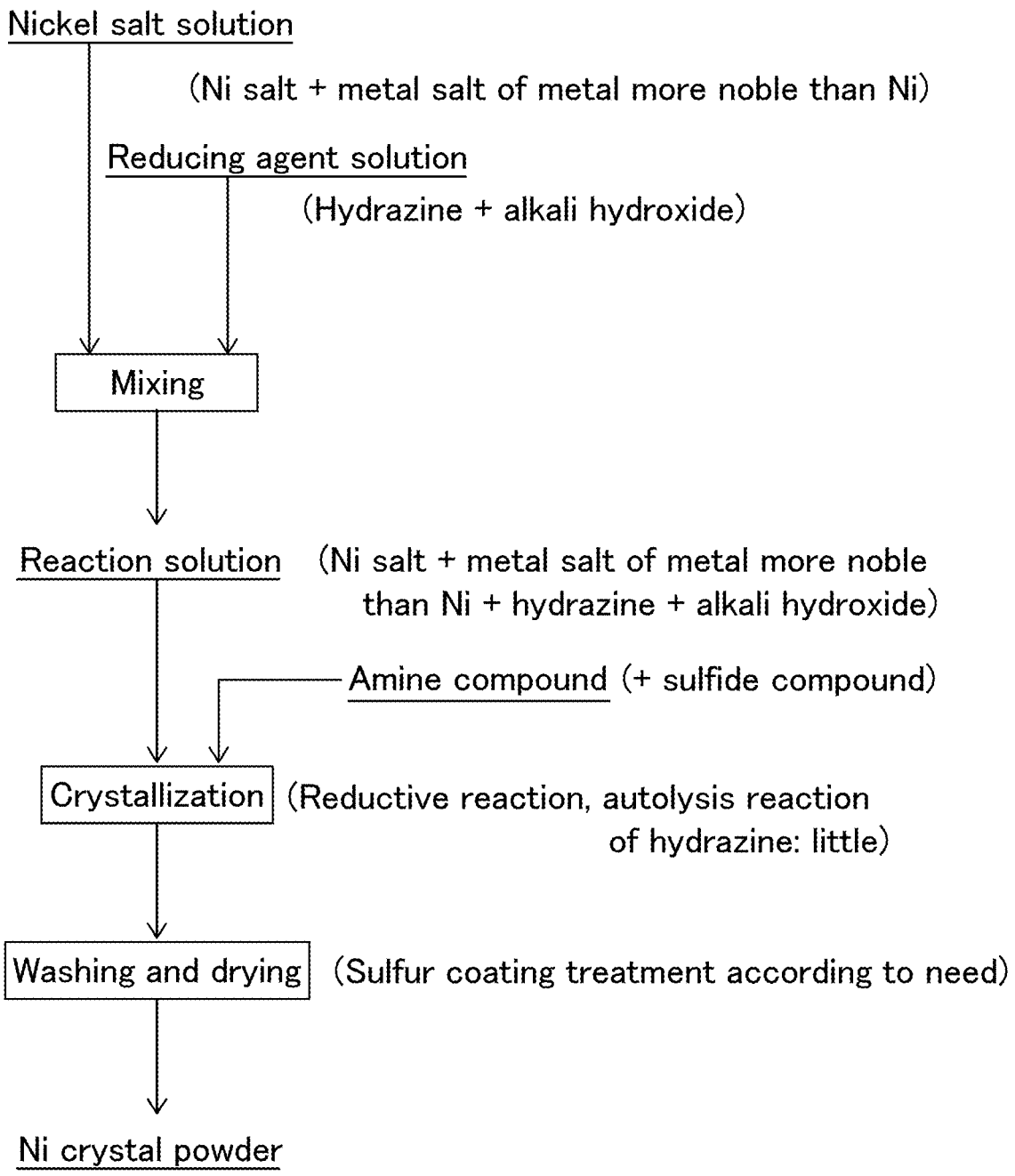
FIG. 3 is a schematic diagram illustrating crystallization procedures relating to second embodiment of a crystallization step in the process for producing nickel powder relating to one embodiment of the present invention.

As illustrated in FIG. 3, in crystallization procedure relating to second embodiment, nickel salt solution, in which at least water-soluble nickel salt and metal salt of metal more noble than nickel are dissolved in water, and reducing agent solution containing at least reducing agent, alkali hydroxide and water are prepared, and after adding and mixing nickel salt solution to reducing agent solution, or vice versa, after adding and mixing reducing agent solution to nickel salt solution, amine compound as autolysis inhibitor of hydrazine is added and mixed, and further, according to need, sulfide compound as autolysis inhibition adjuvant of hydrazine is added and mixed to perform crystallization reaction.

Figure 4:
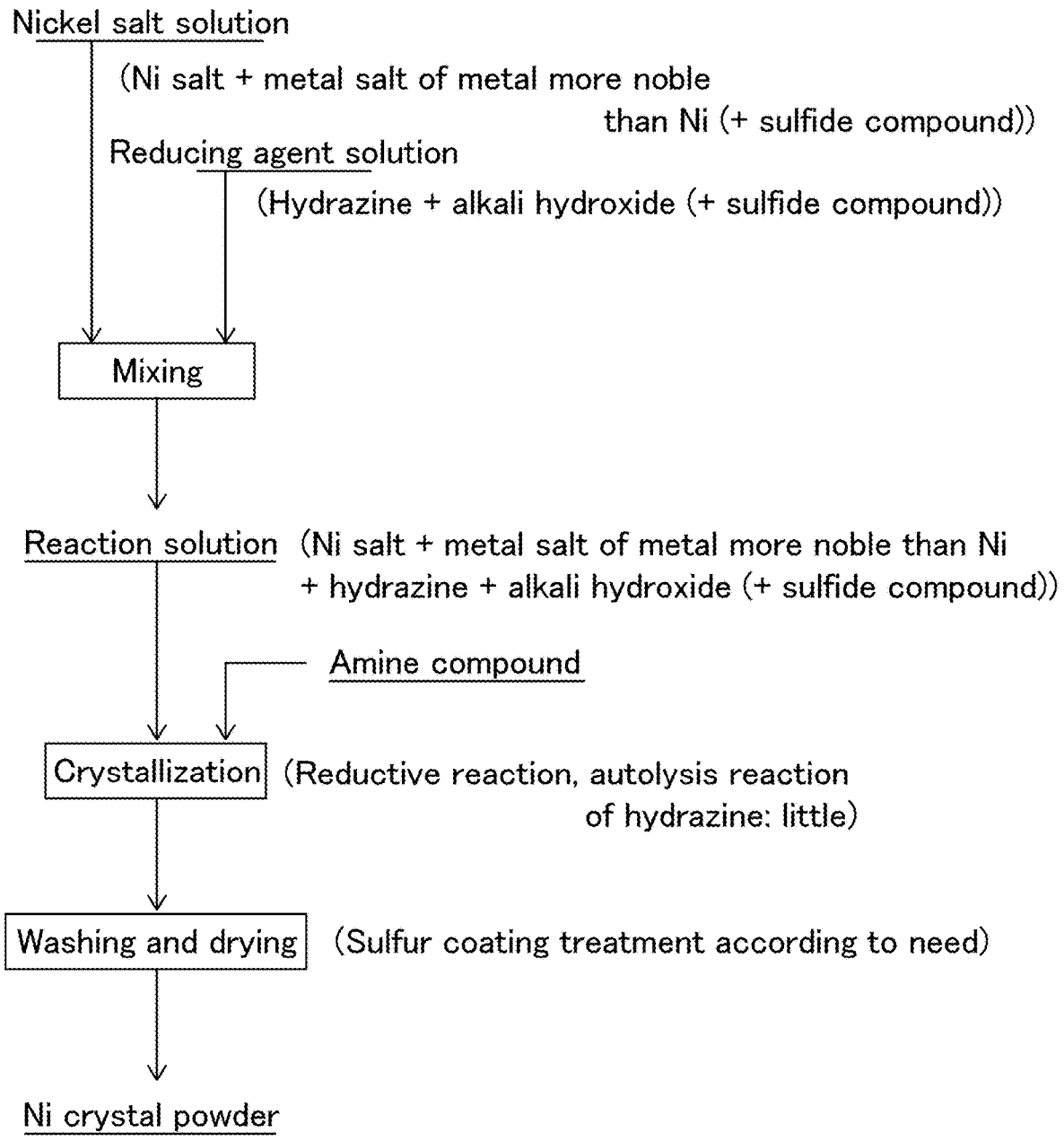
FIG. 4 is a schematic diagram illustrating crystallization procedures relating to third embodiment of a crystallization step in the process for producing nickel powder relating to one embodiment of the present invention.

As illustrated in FIG. 4, in crystallization procedure relating to third embodiment, nickel salt solution, in which at least water-soluble nickel salt and metal salt of metal more noble than nickel are dissolved in water, and reducing agent solution containing at least reducing agent, alkali hydroxide and water are prepared, and, according to need, after adding sulfide compound as autolysis inhibition adjuvant of hydrazine to at least either of nickel salt solution or reducing agent solution, nickel salt solution is added to and mixed with reducing agent solution, or vis versa, reducing agent solution is added to and mixed with nickel salt solution, and then, amine compound as autolysis inhibitor of hydrazine is added and mixed to perform crystallization reaction.

Figure 5:
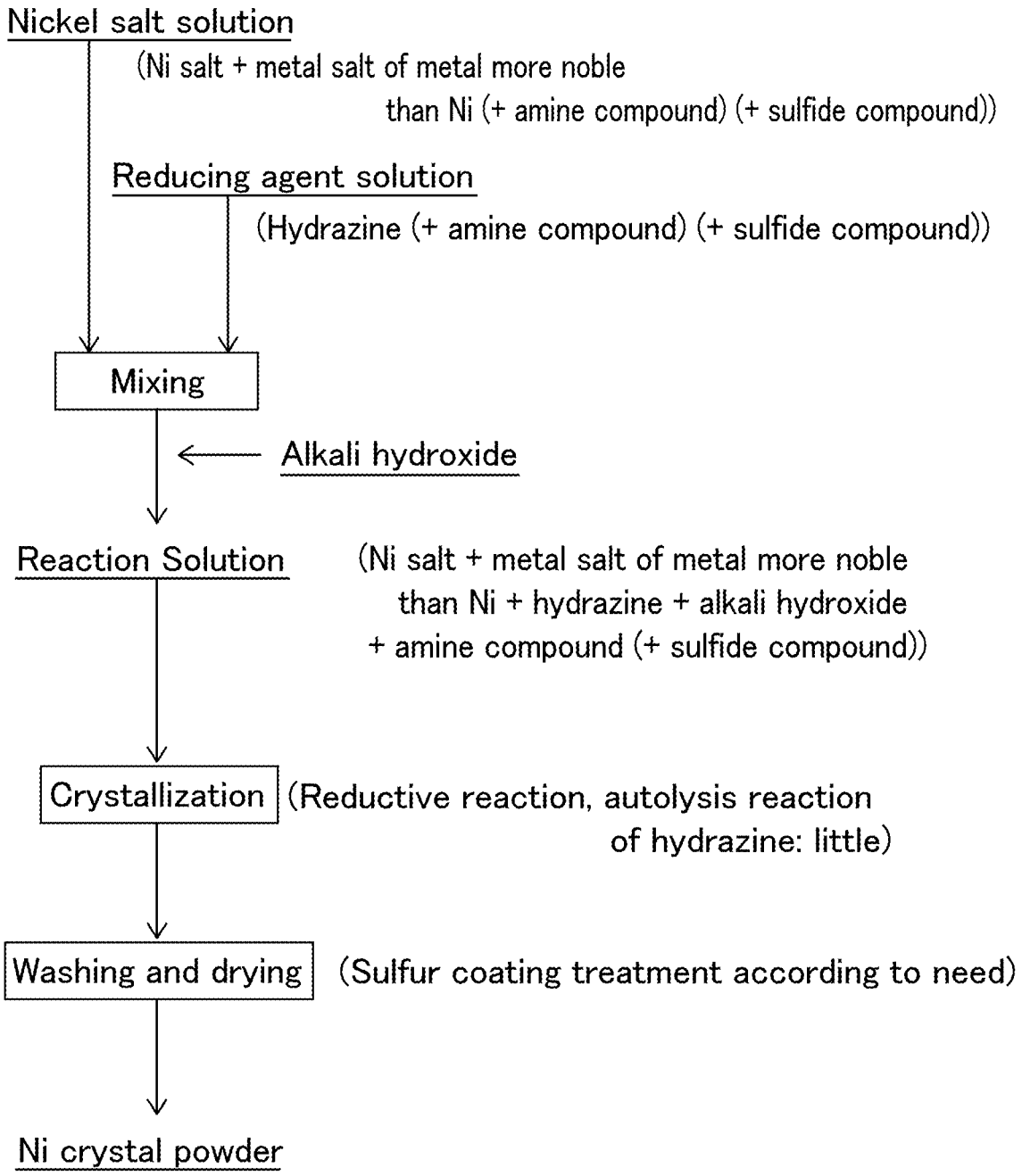
FIG. 5 is a schematic diagram illustrating crystallization procedures relating to fourth embodiment of a crystallization step in the process for producing nickel powder relating to one embodiment of the present invention.

As illustrated in FIG. 5, in crystallization procedure relating to fourth embodiment, nickel salt solution, in which at least water-soluble nickel salt and metal salt of metal more noble than nickel are dissolved in water, reducing agent solution containing at least reducing agent and water, and alkali hydroxide solution containing at least alkali hydroxide and water are prepared, and after adding amine compound as autolysis inhibitor of hydrazine to at least either of nickel salt solution, reducing agent solution or alkali hydroxide solution, and further, according to need, after adding sulfide compound as autolysis inhibition adjuvant of hydrazine to at least either of nickel salt solution, reducing agent solution or alkali hydroxide solution, nickel salt solution is mixed with reducing agent solution to obtain nickel salt/reducing agent-containing solution, and further, alkali hydroxide solution is added to and mixed with the nickel salt/reducing agent-containing solution to perform crystallization reaction.

Figure 6:
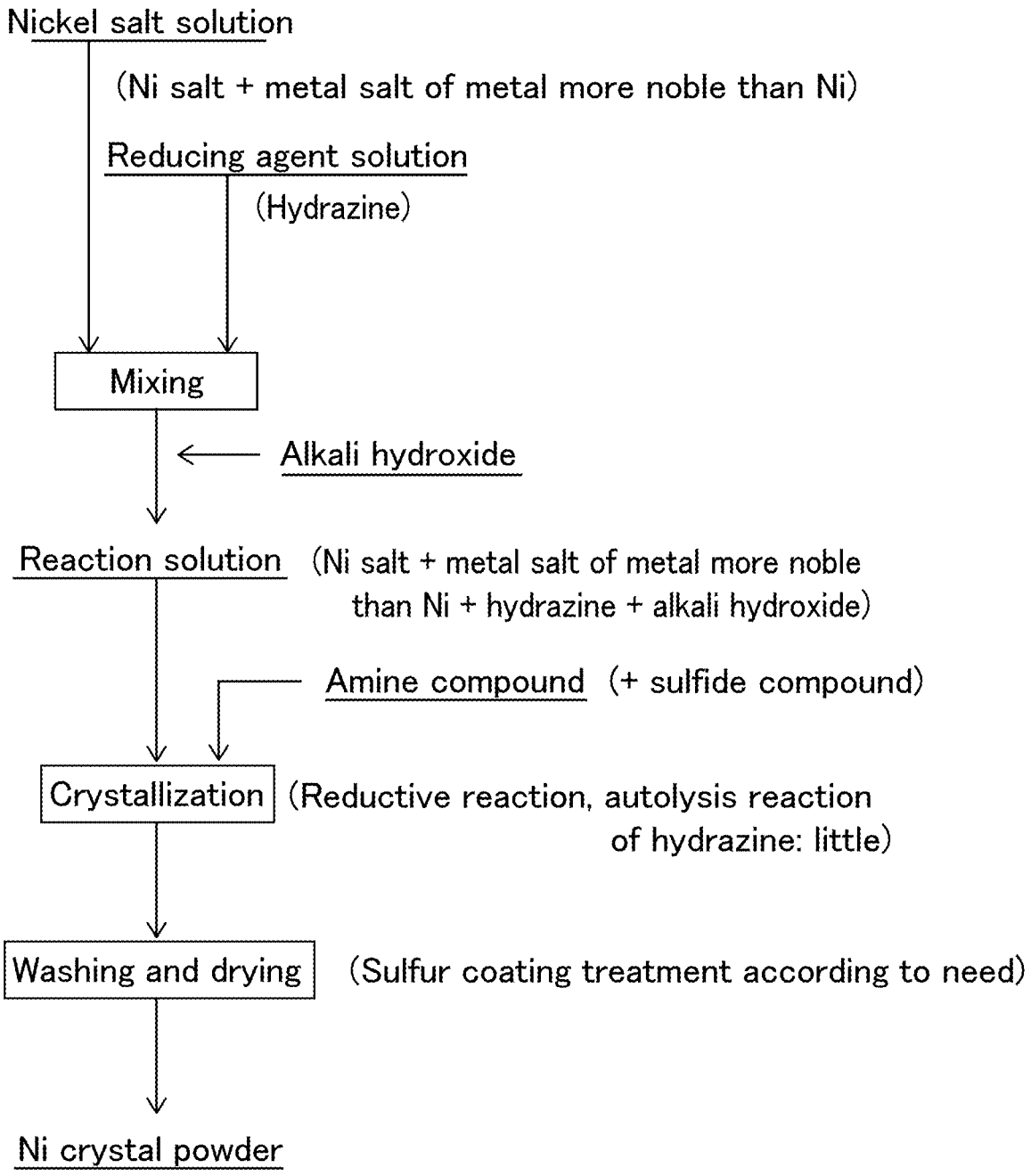
FIG. 6 is a schematic diagram illustrating crystallization procedures relating to fifth embodiment of a crystallization step in the process for producing nickel powder relating to one embodiment of the present invention.

As illustrated in FIG. 6, in crystallization procedure relating to fifth embodiment, nickel salt solution, in which at least water-soluble nickel salt and metal salt of metal more noble than nickel are dissolved in water, reducing agent solution containing at least reducing agent and water, and alkali hydroxide solution containing at least alkali hydroxide and water are prepared, and nickel salt solution is mixed with reducing agent solution to obtain nickel salt/reducing agent-containing solution, and further, alkali hydroxide solution is added to and mixed with the nickel salt/reducing agent-containing solution, and then, amine compound as autolysis inhibitor of hydrazine is added and mixed, and further, according to need, sulfide compound as autolysis inhibition adjuvant of hydrazine is added and mixed to perform crystallization reaction.

Figure 7:
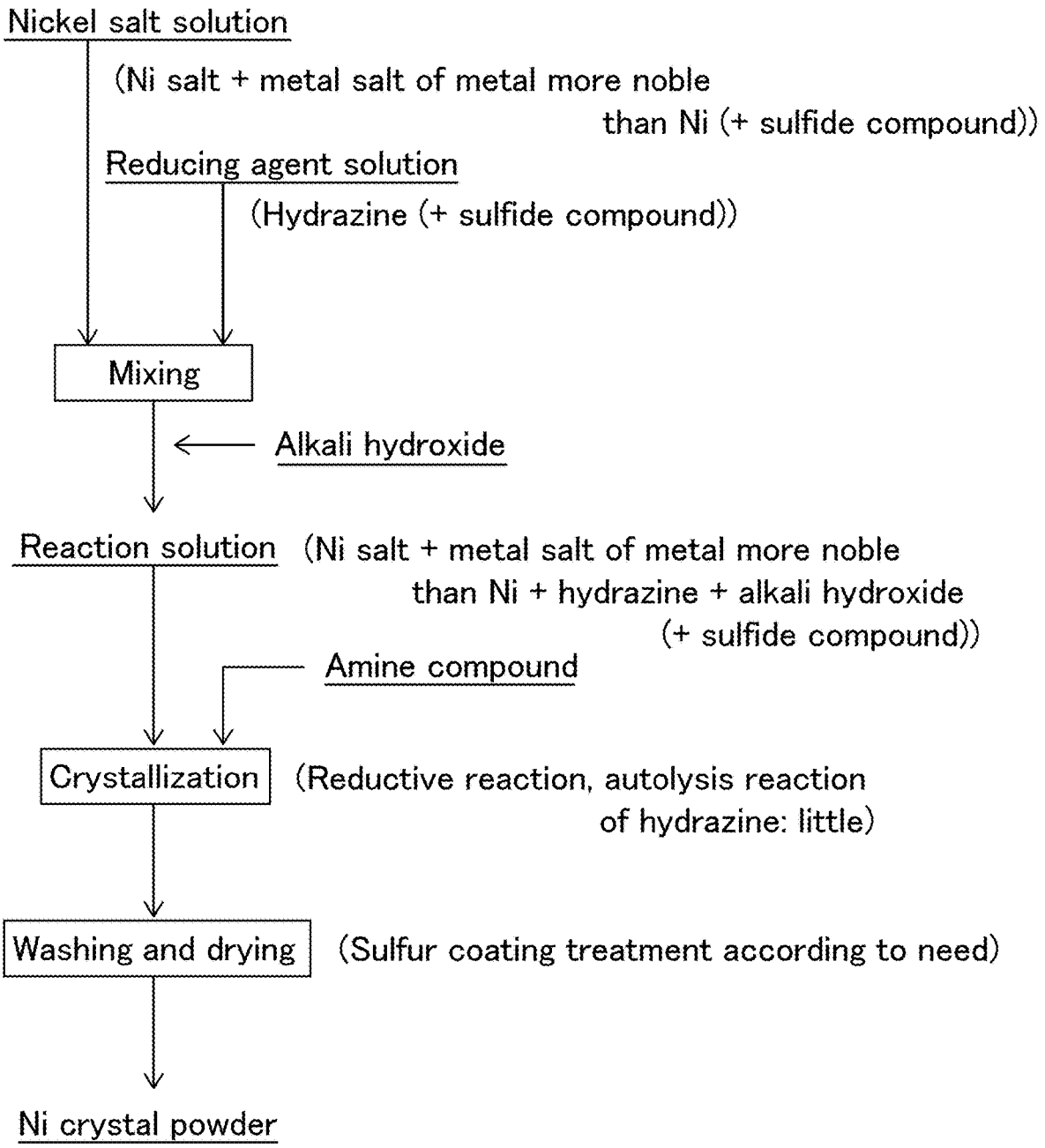
FIG. 7 is a schematic diagram illustrating crystallization procedures relating to sixth embodiment of a crystallization step in the process for producing nickel powder relating to one embodiment of the present invention.

As illustrated in FIG. 7, in crystallization procedure relating to sixth embodiment, nickel salt solution, in which at least water-soluble nickel salt and metal salt of metal more noble than nickel are dissolved in water, reducing agent solution containing at least reducing agent and water, and alkali hydroxide solution containing at least alkali hydroxide and water are prepared, and, according to need, after adding sulfide compound as autolysis inhibition adjuvant of hydrazine to at least either of nickel salt solution or reducing agent solution, nickel salt solution is mixed with reducing agent solution to obtain nickel salt/reducing agent-containing solution, and further, alkali hydroxide solution is added to and mixed with the nickel salt/reducing agent-containing solution, and then, amine compound as autolysis inhibitor of hydrazine is added and mixed to perform crystallization reaction.

Here, crystallization procedure relating to first to third embodiments (FIGS. 2 to 4) is a crystallization procedure to formulate reaction solution by adding and mixing reducing agent solution (hydrazine+alkali hydroxide) to nickel salt solution (nickel salt+metal salt of metal more noble than nickel), or vice versa, by adding and mixing nickel salt solution (nickel salt+metal salt of metal more noble than nickel) to reducing agent solution (hydrazine+alkali hydroxide). Depending on a temperature (reaction starting temperature) when reaction solution (nickel salt+metal salt of metal more noble than nickel+hydrazine+alkali hydroxide) is formulated, i.e. when reductive reaction has started, but if time (raw material mixing time) required for adding and mixing nickel salt solution to reducing agent solution becomes longer, from midpoint of addition and mixing, alkalinity will be increased at a part of addition and mixing region of nickel salt solution and reducing agent solution and reduction power of hydrazine will be increased, and nucleation caused by metal salt (nucleating agent) of metal more noble than nickel occurs, so dependency of nucleation to raw material mixing time will be high as nucleation function of added nucleating agent becomes weaker as it approaches the end of raw material mixing time, and it tends not to be able to obtain narrow particle size distribution or refinement of nickel crystal powder. This tendency is more clearly shown when weak-acidic nickel salt solution is added and mixed to alkali reducing agent solution. The tendency can be inhibited as raw material mixing time is shorter, so it is desirable to be short time, but considering restriction in aspect of mass-production facility, it is preferably 10 to 180 seconds, more preferably 20 to 120 seconds, further more preferably 30 to 80 seconds.

On the other hand, crystallization procedure relating to fourth to sixth embodiments (FIGS. 5 to 7) is a crystallization procedure to formulate reaction solution by adding and mixing reducing agent solution (hydrazine) to nickel salt solution (nickel salt+metal salt of metal more noble than nickel), or vice versa, by adding and mixing nickel salt solution (nickel salt+metal salt of metal more noble than nickel) to reducing agent solution (hydrazine) to obtain nickel salt/reducing agent-containing solution (nickel salt+metal salt of metal more noble than nickel+hydrazine), and further by adding and mixing alkali hydroxide solution (alkali hydroxide) to the nickel salt/reducing agent-containing solution in prescribed time (alkali hydroxide mixing time). In nickel salt/reducing agent-containing solution, hydrazine as reducing agent is already added and mixed to be in uniform concentration, so dependency of nucleation to alkali hydroxide mixing time which occurs when adding and mixing alkali hydroxide solution will not be high as dependency of nucleation to raw material mixing time in the crystallization procedure relating to first and second embodiments, so there are characteristics that it tends to obtain narrow particle size distribution and refinement of nickel crystal powder. However, by the same reason as in the crystallization procedure relating to first and second embodiments, alkali hydroxide mixing time is desirable to be short time, and considering restriction in aspect of mass-production facility, it is preferably 10 to 180 seconds, more preferably 20 to 120 seconds, further more preferably 30 to 80 seconds.

The crystal procedure relating to first and fourth embodiments (FIGS. 2 and 5) is having an advantage that amine compound or sulfide compound functions as autolysis inhibitor of hydrazine and accelerator of reductive reaction (complexing agent) from at the time of start of nucleation caused by metal salt of metal more noble than nickel (nucleating agent), as amine compound or amine compound and sulfide compound is previously blended in reaction solution, but on the other hand, interaction (for example, adsorption) of amine compound or sulfide compound with surface of nickel particles will be involved with nucleation, and there is a possibility that it influences particle size distribution or particle size of obtained nickel crystal powder.

Adversely, in the crystal procedure relating to second and fifth embodiments (FIGS. 3 and 6), amine compound is or amine compound and sulfide compound are added and mixed to reaction solution after going through initial stage of crystallization step in which nucleation occurs caused by metal salt of metal more noble than nickel (nucleating agent), so functions of amine compound and sulfide compound as autolysis inhibitor of hydrazine and accelerator of reductive reaction (complexing agent) will be exerted little late, but amine compound and sulfide compound will not be involved with nucleation, so particle size distribution or particle size of obtained nickel crystal powder tends not to be influenced by amine compound or sulfide compound, and there is an advantage that it will be easy to control particle size distribution or particle size of obtained nickel crystal powder. Here, mixing time when adding and mixing amine compound or amine compound and sulfide compound to reaction solution in the crystal procedure relating to second and fifth embodiments may be added at once within few seconds, or may be added separately or added by dripping over few minutes to 30 minutes. Amine compound also functions as accelerator of reductive reaction (complexing agent), so crystal growth will progress gradually when it is added gradually and nickel crystal powder will be having high crystallinity, but autolysis inhibition of hydrazine also functions gradually and effect of reducing used amount of hydrazine will be decreased, so the mixing time may be decided accordingly while trying to balance these matters.

Meanwhile, in the crystallization procedure relating to third and sixth embodiments (FIGS. 4 and 7), after sulfide compound is added according to need, and after going through initial stage of crystallization step in which nucleation occurs caused by metal salt of metal more noble than nickel (nucleating agent), amine compound is added and mixed to reaction solution. Therefore, if sulfide compound is added, sulfide compound is blended in reaction solution previously, as well as the crystallization procedure relating to first and fourth embodiments (FIGS. 2 and 5), so it is having an advantage that sulfide compound functions as autolysis inhibitor of hydrazine from at the time of start of nucleation caused by metal salt of metal more noble than nickel (nucleating agent), but on the other hand, interaction (for example, adsorption) of sulfide compound with surface of nickel particles will be involved with nucleation, and there is a possibility that it influences particle size distribution or particle size of obtained nickel crystal powder. Adversely, if sulfide compound is not added, amine compound is added and mixed to reaction solution after going through initial stage of crystallization step in which nucleation occurs caused by metal salt of metal more noble than nickel (nucleating agent), as well as the crystallization procedure relating to second and fifth embodiments (FIGS. 3 and 6), so functions of amine compound as autolysis inhibitor of hydrazine and accelerator of reductive reaction (complexing agent) will be exerted little late, but amine compound will not be involved with nucleation, so particle size distribution or particle size of obtained nickel crystal powder tends not to be influenced by amine compound, and there is an advantage that it will be easy to control particle size distribution or particle size of obtained nickel crystal powder. In addition, about timing to add and mix amine compound in the crystallization procedure relating to first to sixth embodiments, it is possible to select accordingly by judging comprehensively according to purpose Addition and mixing of nickel salt solution and reducing agent solution, or addition and mixing of alkali hydroxide solution to nickel salt/reducing agent-containing solution is preferable to be stirring-mixing in which it is mixed while stirring solution. If it is easy to be stirred and mixed, it depends on location of nucleation but ununiformity will be decreased (become uniform), and also, the dependency of nucleation on raw material mixing time or alkali hydroxide mixing time will be decreased, so it will be easier to obtain narrow particle size distribution and refinement of nickel crystal powder. As process of stirring-mixing, publicly known process can be used, and it is preferable to use stirring blade from aspects of facility cost or control of stirring-mixing.

(1-1-3. Crystallization Reaction (Reductive Reaction, Autolysis Reaction of Hydrazine))

In crystallization step, nickel crystal powder is obtained while inhibiting autolysis of hydrazine significantly by a function of infinitesimal amount of amine compound or amine compound and sulfide compound, and simultaneously, while nickel salt (accurately, nickel ion, or nickel complex ion) is reduced by hydrazine in coexistence of metal salt of metal more noble than nickel and alkali hydroxide, in reaction solution.

At first, explaining about reductive reaction in crystallization step. Reaction of nickel (Ni) is two-electron reaction of following formula (1), and reaction of hydrazine is four-electron reaction of following formula (2), and for example, as mentioned above, when nickel chloride is used as nickel salt and when sodium hydroxide is used as alkali hydroxide, entire reductive reaction is indicated as following formula (3), as reaction in which nickel hydroxide ($Ni(OH)_2$) generated by neutralization reaction of nickel chloride and sodium hydroxide is reduced by hydrazine, and stoichiometrically (in ideal value), 0.5 mol of hydrazine ($N_2H_4$) is required for 1 mol of nickel (Ni).

Here, from reductive reaction of hydrazine of the formula (2), it can be understood that reduction power of hydrazine becomes stronger as alkalinity is stronger. The alkali hydroxide is used as pH conditioner for increasing alkalinity, and serves to accelerate reductive reaction of hydrazine.

$$Ni^{2+}+2e^{-}\rightarrow Ni\downarrow \text{ (Two-electron reaction)} \quad (1)$$

$$N_2H_4\rightarrow N_2\uparrow+4H^{+}4e^{-} \text{ (Four-electron reaction)} \quad (2)$$

$$2NiCl_2+N_2H_4+4NaOH\rightarrow 2Ni(OH)_2+N_2H_4+4NaCl\rightarrow 2Ni\downarrow+N_2\uparrow+4NaCl+4H_2O \quad (3)$$

As mentioned above, in conventional crystallization step, active surface of nickel crystal powder will be catalyst, autolysis reaction of hydrazine indicated in following formula (4) will be accelerated, and large quantity hydrazine as reducing agent will be consumed for other than reducing action, so it depends on crystallization condition (reaction starting temperature and else), but for example, about 2 mol of hydrazine were generally used with respect to 1 mol of nickel (about four times the ideal value required for reduction). Further, autolysis of hydrazine creates a byproduct of a lot of ammonia (refer to formula (4)), and ammonia will be contained in high concentration in reaction solution to generate nitrogen-containing waste liquid. Such excessive use of hydrazine which is expensive medicament, and occurrence of cost for treating nitrogen-containing waste liquid were causes of increase in cost of nickel power by wet process (wet type nickel powder).

$$3N_2H_4\rightarrow N_2\uparrow+4NH_3 \quad (4)$$

In the process for producing nickel powder relating to one embodiment of the present invention, by adding infinitesimal amount of specific amine compound or amine compound and sulfide compound to reaction solution, it is possible to inhibit autolysis reaction of hydrazine significantly, and significant reduction of used amount of hydrazine expensive as medicament can be achieved. The detailed mechanism of this feature has not been clarified yet, but (I) molecules of the specific amine compound and sulfide compound adsorb to surface of nickel crystal powder in reaction solution, and preventing contact between active surface of nickel crystal powder and hydrazine molecules, (II) molecules of specific amine compound or sulfide compound functions to surface of nickel crystal powder to inactivate catalytic activity of the surface, and else can be presumed, but it is considered that mechanism of (I) is convincing.

In addition, in crystallization step of conventional wet process, in order to shorten reductive reaction time (crystallization reaction time) to a practical range, complexing agent for improving ion shaped nickel concentration by forming complex ion and nickel ion ($Ni^{2+}$) such as tartaric acid or citric acid is generally used as accelerator of reductive reaction, but these complexing agents such as tartaric acid and citric acid are scarcely having functions of autolysis inhibitor of hydrazine and autolysis inhibition adjuvant of hydrazine as the specific amine compound or sulfide compound.

On the other hand, the specific amine compound also functions as complexing agent as well as tartaric acid or citric acid, and it is having an advantage that it is having both functions of autolysis inhibitor of hydrazine and accelerator of reductive reaction. In addition, the specific amine compound or sulfide compound is also having a function as coupling inhibitor which tends to prevent formation of coarse particles generated by coupling of nickel particles themselves during crystallization. The present invention has been completed based on such findings.

(1-1-4. Crystallization Condition (Reaction Starting Temperature))

As crystallization condition of crystallization step, a temperature (reaction starting temperature) of reaction solution when reaction solution at least containing nickel salt, metal salt of metal more noble than nickel, hydrazine, alkali hydroxide, and according to need, amine compound or amine compound and sulfide compound (amine compound is always contained in reaction solution finally) is blended, in other words, a temperature of reaction solution when reductive reaction is started is preferably 40° C. to 90° C., more preferably 50° C. to 80° C., and further, more preferably 60° C. to 70° C. In addition, a temperature of each solution such as nickel salt solution, reducing agent solution and alkali hydroxide solution can be set freely without limitation as long as a temperature (reaction starting temperature) of reaction solution obtained by mixing these solutions is in the above temperature range. It tends to accelerate reductive reaction, and also, nickel crystal powder is highly crystallized when reaction starting temperature is higher, but on the other hand, there is an aspect that autolysis reaction of hydrazine is accelerated more, so consumed amount of hydrazine will be increased, and also, reaction solution tends to foam intensely. Therefore, when reaction starting temperature is too high, there is a case that consumed amount of hydrazine will be increased significantly, and that crystallization reaction cannot be continued due to large amount of foaming. On the other hand, when reaction starting temperature is too low, crystallinity of nickel crystal powder tends to decrease significantly, and productivity tends to decrease as time of crystallization step will be prolonged significantly as reductive reaction is delayed. From reasons above, by making the reaction starting temperature in the above temperature range, it is possible to produce high-performance nickel crystal powder inexpensively, while maintaining high productivity, and also, while inhibiting consumed amount of hydrazine.

(1-1-5. Recovery of Nickel Crystal Powder)

As mentioned above, nickel crystal powder generated in reaction solution with reductive reaction by hydrazine may be separated from reaction solution using publicly known procedures, after applying sulfur coating treatment by sulfur compound such as mercapto compound or disulfide compound, according to need. As concrete process, nickel crystal powder is solid-liquid separated from reaction solution using Denver filter, filter press, centrifugal separator, decanter and else, and also, washed sufficiently using high purity water such as pure water (conductivity: ≤1 μS/cm), and dried in 50° C. to 300° C., preferably in 80° C. to 150° C. using generic drying device such as air dryer, hot air dryer, inert gas atmosphere dryer, and vacuum dryer, to obtain nickel crystal powder (nickel powder). In addition, when it is dried in about 200° C. to 300° C. in inert gas atmosphere, reductive atmosphere, vacuum atmosphere or the like, by using drying device such as inert gas atmosphere dryer and vacuum dryer, it is possible to obtain nickel crystal powder applied with heat treatment, in addition to simple drying.

(1-2. Disintegrating Step (Post-Treatment Step))

As mentioned above, in nickel crystal powder (nickel powder) obtained in crystallization step, content ratio of coarse particles formed by nickel particles coupling to each other during reduction precipitation is not so high at the first place, as amine compound or amine compound and sulfide compound function as coupling inhibitor of nickel particles during crystallization. However, depending on crystallization procedure or crystallization condition, there is a case that it will be a problem as content ratio of coarse particle will be high to some extent, so as illustrated in FIG. 1, it is preferable to reduce coarse particles by separating coarse particles in which nickel particles are coupled by its coupling portion, by arranging disintegrating step after crystallization step. As disintegrating step, dry type disintegrating process such as spiral jet disintegrating treatment or counter jet mill disintegrating treatment, or wet type disintegrating process such as high pressure fluid collision disintegrating treatment, or other generic disintegrating process can be applied.

<2. Nickel Powder>

Nickel powder obtained by process for producing nickel powder relating to one embodiment of the present invention can be obtained by wet process in which used amount of hydrazine as reducing agent is decreased significantly, and it is inexpensive and also having high-performance, so it is suitable for the internal electrode of the laminated ceramic capacitor. As characteristics of nickel powder, following average particle size, content of impurities (chlorine content, alkali metal content), sulfur content, crystallite diameter and content of coarse particles are respectively calculated and evaluated.

(Average Particle Size)

From a point of view of corresponding to thinning of the internal electrode of the laminated ceramic capacitor recently, average particle size of nickel powder is preferably 0.5 m or less. Average particle size in this specification is number average of particle size calculated from scanning electron micrograph (SEM image) of nickel powder.

(Content of Impurities (Chlorine Content, Alkali Metal Content))

In nickel powder by wet process, chlorine and alkali metal are contained, and which are impurities caused by medicament. There is a possibility that these impurities will be a cause of occurrence of defect of the internal electrode when producing the laminated ceramic capacitor, so it is preferable to reduce impurities as possible, and concretely, it is preferable that both chlorine and alkali metal are 0.01 mass % or less.

(Sulfur Content)

It is preferable that nickel powder applied to the internal electrode of the laminated ceramic capacitor contains sulfur. Surface of nickel powder is having a function to accelerate pyrolysis of binder resin such as ethyl cellulose contained in internal electrode paste, and there is a case that crack occurs by occurrence of large amount of cracked gas as binder resin is decomposed from low temperature in debinding treatment when producing the laminated ceramic capacitor. It is known that the function to accelerate pyrolysis of this binder resin can be inhibited significantly by adhering sulfur on surface of nickel powder. In order to achieve the above purpose, sulfur content is preferably 1 mass % or less. When sulfur content is more than 1 mass %, defect and else of the internal electrode due to sulfur will be occurred.

(Crystallite Diameter)

Crystallite diameter is an index indicating degree of crystallization, and it indicates that as crystallite diameter is larger crystallinity becomes higher. As mentioned above, nickel powder by vapor phase process is obtained via high temperature process of more than about 1000° C., so crystallite diameter is 80 nm or more and it is excellent in crystallinity. It is preferable that nickel powder by wet process is also having large crystallite diameter, and it is desirable to be 25 nm or more, preferably 30 nm or more. There are several manners in process for measuring crystallite diameter, but in this specification, crystallite diameter is calculated by Scherrer process by performing X-ray diffraction measurement. In Scherrer process, it will be influenced strongly by crystal strain, so nickel crystal powder with little strain will be object of measurement, not nickel crystal powder after disintegrating treatment step in which a lot of strains occur, and its measurement value will be crystallite diameter.

(Content of Coarse Particles)

Content of coarse particles in nickel powder is calculated by photographing scanning electron micrograph (SEM image) (magnification: 10000 times) from 20 views, and in SEM images of these 20 views, by measuring content (%) of coarse particles with particle size 0.5 μm or more formed mainly by coupling of nickel particles, i.e. number of coarse particles/number of entire particles×100. From a point of view of corresponding to thinning of the internal electrode of the laminated ceramic capacitor, it is desirable that content of coarse particles with particle size 0.5 μm or more is 1% or less, preferably 0.1% or less, more preferably 0.05% or less, further more preferably 0.01% or less.

EXAMPLES

Next, explaining concretely about a process for producing nickel powder relating to one embodiment of the present invention by using examples, but the present invention should not be limited by the following examples.

Example 1

[Preparation of Nickel Salt Solution]

405 g of nickel chloride hexahydrate ($NiCl_2.6H_2O$, molecular weight: 237.69) as nickel salt, and 2.41 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 9.0 mass ppm (5.0 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 215 g, and reducing agent solution was prepared, which is aqueous solution containing hydrazine as main component, and not containing alkali hydroxide. Molar ratio of hydrazine contained in reducing agent solution with respect to nickel was 1.51.

[Alkali Hydroxide Solution]

230 g of sodium hydroxide (NaOH, molecular weight: 40.0) as alkali hydroxide was dissolved in 560 mL of pure water, and alkali hydroxide solution was prepared, which is aqueous solution containing sodium hydroxide as main component. Molar ratio of sodium hydroxide contained in alkali hydroxide solution with respect to nickel was 5.75.

[Amine Compound Solution]

2.048 g of ethylene diamine (EDA) ($H_2NC_2H_4NH_2$, molecular weight: 60.1) which is alkylene amine containing two primary amino groups (—$NH_2$) in molecule as amine compound as autolysis inhibitor and accelerator of reductive reaction (complexing agent) was dissolved in 18 mL of pure water, and amine compound solution was prepared, which is aqueous solution containing ethylene diamine as main component. Molar ratio of ethylene diamine contained in amine compound solution with respect to nickel was 0.02 (2.0 mol %), and it was minute amount.

In addition, as used materials in the nickel salt solution, the reducing agent solution, the alkali hydroxide solution, and the amine compound solution, reagents made of Wako Pure Chemical Corporation were used, except for 60% hydrazine hydrate.

[Crystallization Step]

Crystallization reaction was performed in crystallization procedure illustrated in FIG. 5 using the above medicaments, and nickel crystal powder was obtained. In other words, after pouring nickel salt solution in which nickel chloride and palladium salt are dissolved in pure water into Teflon coated stainless container with stirring blades, and after heating it to be liquid temperature of 75° C. while stirring, the reducing agent solution containing hydrazine and water in liquid temperature of 25° C. was added and mixed to this nickel salt solution in mixing time of 20 seconds, and nickel salt/reducing agent-containing solution was obtained. The alkali hydroxide solution containing sodium hydroxide and water in liquid temperature of 25° C. was added and mixed to this nickel salt/reducing agent-containing solution in mixing time of 80 seconds, and reaction solution (nickel chloride+palladium salt+hydrazine+sodium hydroxide) in liquid temperature of 63° C. was prepared, and reductive reaction (crystallization reaction) was started (reaction starting temperature: 63° C.). As indicated in the formula (3), color tone of reaction solution was yellow green of nickel hydroxide ($Ni(OH)_2$) right after preparation of reaction solution, but after few minutes from start of reaction (preparation of reaction solution), reaction solution changed its color (yellow green to grey) along with nucleation by action of nucleating agent (palladium salt). From after 8 minutes after start of reaction when reaction solution was changed to dark grey until after 18 minutes, the amine compound solution was dripped and mixed over 10 minutes, and nickel crystal powder was precipitated in reaction solution by progressing reductive reaction while inhibiting autolysis of hydrazine. Within 90 minutes from the start of reaction, reductive reaction of formula (3) was completed, and it was confirmed that supernatant liquid of reaction solution was transparent, and all of nickel components in reaction solution were reduced to metallic nickel.

By the way, in supernatant liquid of the reaction solution, hydrazine was remained slightly, when measuring amount of remained hydrazine, with respect to 215 g of 60% hydrazine hydrate blended in reducing agent solution, amount of 60% hydrazine hydrate consumed in crystallization reaction was 212 g, and molar ratio with respect to nickel was 1.49. Here, molar ratio of hydrazine consumed in reductive reaction with respect to nickel can be presumed as 0.5 from the formula (3), so it can be estimated that molar ratio of hydrazine consumed by autolysis with respect to nickel was 0.99.

Reaction solution containing nickel crystal powder was slurry, and surface treatment (sulfur coating treatment) of nickel crystal powder was applied by adding aqueous solution of mercapto acetic acid (thioglycolic acid) ($HSCH_2COOH$, molecular weight: 92.12) to this slurry containing nickel crystal powder. After surface treatment, slurry containing nickel crystal powder was filtered and washed until conductivity of filtrate filtered from slurry containing nickel crystal powder became 10 μS/cm or less, using pure water with conductivity of 1 μS/cm, and after solid-liquid separation, it was dried in vacuum dryer set to a temperature of 150° C., and nickel crystal powder (nickel powder) was obtained.

[Disintegrating Treatment Step (Post-Treatment Step)]

Figure 8:
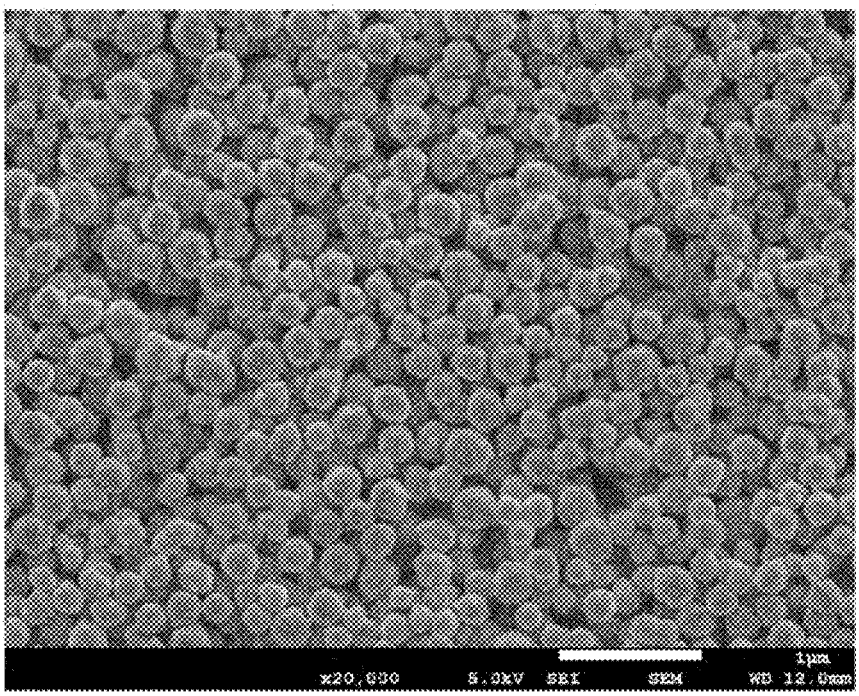
FIG. 8 is a scanning electron micrograph (SEM image) of nickel powder relating to an example 1.

As illustrated in FIG. 1, disintegrating step was performed after crystallization step, in order to reduce coarse particles formed mainly by coupling of nickel particles in nickel powder. Concretely, spiral jet disintegrating treatment which is dry type disintegrating process was performed to the nickel crystal powder (nickel powder) obtained by crystallization step, and nickel powder relating to example 1, in which minute amount of amine compound (ethylene diamine: EDA) was applied to crystallization reaction of wet process as autolysis inhibitor of hydrazine, was obtained. In addition, scanning electron micrograph (SEM image) of obtained nickel powder is illustrated in FIG. 8.

Example 2

[Preparation of Nickel Salt Solution]

405 g of nickel chloride hexahydrate ($NiCl_2.6H_2O$, molecular weight: 237.69) as nickel salt, and 1.60 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 6.0 mass ppm (3.3 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 240 g, and reducing agent solution was prepared, which is aqueous solution containing hydrazine as main component, and not containing alkali hydroxide. Molar ratio of hydrazine contained in reducing agent solution with respect to nickel was 1.69.

[Amine Compound Solution]

0.088 g of diethylene triamine (DETA) ($H_2NC_2H_4NHC_2H_4NH_2$, molecular weight: 103.17) which is alkylene amine containing two primary amino groups (—$NH_2$), and also, one secondary amino group (—NH—) in molecule as amine compound as autolysis inhibitor and accelerator of reductive reaction (complexing agent) was dissolved in 20 mL of pure water, and amine compound solution was prepared, which is aqueous solution containing diethylene triamine as main component. Molar ratio of diethylene triamine contained in amine compound solution with respect to nickel was 0.0005 (0.05 mol %), and it was infinitesimal amount.

In addition, as used materials in the nickel salt solution, the reducing agent solution, and the amine compound solution, reagents made of Wako Pure Chemical Corporation were used, except for 60% hydrazine hydrate.

[Crystallization Step]

Except for using the above each medicament (nickel salt solution, reducing agent solution and amine compound solution), crystallization reaction with reaction starting temperature of 63° C. was performed as well as example 1, and after surface treatment, the reaction solution was washed, solid-liquid separated, and dried, and nickel crystal powder was obtained.

With respect to 240 g of 60% hydrazine hydrate blended in reducing agent solution, amount of 60% hydrazine hydrate consumed in crystallization reaction was 228 g, and molar ratio with respect to nickel was 1.60. Here, molar ratio of hydrazine consumed in reductive reaction with respect to nickel can be presumed as 0.5 from the formula (3), so it can be estimated that molar ratio of hydrazine consumed by autolysis with respect to nickel was 1.10.

Spiral jet disintegrating treatment as well as example 1 was performed to the nickel crystal powder, and nickel powder relating to example 2, in which infinitesimal amount of amine compound (diethylene triamine: DETA) was applied to crystallization reaction of wet process as autolysis inhibitor of hydrazine, was obtained.

Example 3

[Preparation of nickel salt solution]

405 g of nickel chloride hexahydrate ($NiCl_2.6H_2O$, molecular weight: 237.69) as nickel salt, 1.60 mg of palladium (II) chloride ammonium (tetrachloropalladium (II) ammonium dihydrate) ($(NH_4)_2PdCl_4$, molecular weight: 284.31) as metal salt of metal more noble than nickel, and 1.28 g of tartaric acid ($(HOOC)CH(OH)CH(OH)(COOH)$, molecular weight: 150.09) as accelerator of reductive reaction (complexing agent) were dissolved in 1880 mL of pure water, and nickel salt solution was prepared, which is aqueous solution containing nickel salt, nucleating agent which is metal salt of metal more noble than nickel and tartaric acid as accelerator of reductive reaction (complexing agent) as main components. Here, in nickel salt solution, palladium (Pd) was 6.0 mass ppm (3.3 molar ppm) with respect to nickel (Ni). In addition, molar ratio of tartaric acid with respect to nickel was 0.005 (0.50 mol %).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 240 g, and reducing agent solution was prepared, which is aqueous solution containing hydrazine as main component, and not containing alkali hydroxide. Molar ratio of hydrazine contained in reducing agent solution with respect to nickel was 1.69.

[Amine Compound Solution]

0.125 g of tris (2-aminoethyl) amine (TAEA) ($N(C_2H_4NH_2)_3$, molecular weight: 146.24) which is alkylene amine containing three primary amino groups (—$NH_2$) in molecule as amine compound as autolysis inhibitor and accelerator of reductive reaction (complexing agent) was dissolved in 20 mL of pure water, and amine compound solution was prepared, which is aqueous solution containing tris (2-aminoethyl) amine as main component. Molar ratio of tris (2-aminoethyl) amine contained in amine compound solution with respect to nickel was 0.0005 (0.05 mol %), and it was infinitesimal amount.

In addition, as used materials in the nickel salt solution, the reducing agent solution, and the amine compound solution, reagents made of Wako Pure Chemical Corporation were used, except for 60% hydrazine hydrate.

[Crystallization Step]

Except for using the above each medicament (nickel salt solution, reducing agent solution and amine compound solution), crystallization reaction with reaction starting temperature of 63° C. was performed as well as example 1, and after surface treatment, the reaction solution was washed, solid-liquid separated, and dried, and nickel crystal powder was obtained.

With respect to 240 g of 60% hydrazine hydrate blended in reducing agent solution, amount of 60% hydrazine hydrate consumed in crystallization reaction was 238 g, and molar ratio with respect to nickel was 1.67. Here, molar ratio of hydrazine consumed in reductive reaction with respect to nickel can be presumed as 0.5 from the formula (3), so it can be estimated that molar ratio of hydrazine consumed by autolysis with respect to nickel was 1.17.

Spiral jet disintegrating treatment as well as example 1 was performed to the nickel crystal powder, and nickel powder relating to example 3, in which infinitesimal amount of amine compound (tris (2-aminoethyl) amine: TAEA) was applied to crystallization reaction of wet process as autolysis inhibitor of hydrazine, was obtained.

Example 4

[Preparation of Nickel Salt Solution]

405 g of nickel chloride hexahydrate ($NiCl_2.6H_2O$, molecular weight: 237.69) as nickel salt, and 2.14 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 8.0 mass ppm (4.4 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 225 g, and reducing agent solution was prepared, which is aqueous solution containing hydrazine as main component, and not containing alkali hydroxide. Molar ratio of hydrazine contained in reducing agent solution with respect to nickel was 1.58.

[Amine Compound Solution]

1.775 g of N-(2-aminoethyl) ethanolamine (2-(2-aminoethylamino) ethanol) (AEEA) ($H_2NC_2H_4NHC_2H_4OH$, molecular weight: 104.15) which is alkylene amine containing one primary amino group (—NH), and also, one secondary amino group (—NH—) in molecule as amine compound as autolysis inhibitor and accelerator of reductive reaction (complexing agent) was dissolved in 18 mL of pure water, and amine compound solution was prepared, which is aqueous solution containing N-(2-aminoethyl) ethanolamine as main component. Molar ratio of N-(2-aminoethyl) ethanolamine contained in amine compound solution with respect to nickel was 0.01 (1.0 mol %), and it was minute amount.

In addition, as used materials in the nickel salt solution and the reducing agent solution, reagents made of Wako Pure Chemical Corporation were used, and as used materials in the amine compound solution, reagents made of Tokyo Chemical Industry Co., Ltd. were used.

[Crystallization Step]

Except for using the above each medicament (nickel salt solution, reducing agent solution and amine compound solution), crystallization reaction with reaction starting temperature of 63° C. was performed as well as example 1, and after surface treatment, the reaction solution was washed, solid-liquid separated, and dried, and nickel crystal powder was obtained.

With respect to 225 g of 60% hydrazine hydrate blended in reducing agent solution, amount of 60% hydrazine hydrate consumed in crystallization reaction was 221 g, and molar ratio with respect to nickel was 1.55. Here, molar ratio of hydrazine consumed in reductive reaction with respect to nickel can be presumed as 0.5 from the formula (3), so it can be estimated that molar ratio of hydrazine consumed by autolysis with respect to nickel was 1.05.

Spiral jet disintegrating treatment as well as example 1 was performed to the nickel crystal powder, and nickel powder relating to example 4, in which minute amount of amine compound (N-(2-aminoethyl) ethanolamine: AEEA) was applied to crystallization reaction of wet process as autolysis inhibitor of hydrazine, was obtained.

Example 5

[Preparation of Nickel Salt Solution]

405 g of nickel chloride hexahydrate ($NiCl_2.6H_2O$, molecular weight: 237.69) as nickel salt, and 1.60 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 6.0 mass ppm (3.3 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 172.5 g, and reducing agent solution was prepared, which is aqueous solution containing hydrazine as main component, and not containing alkali hydroxide. Molar ratio of hydrazine contained in reducing agent solution with respect to nickel was 1.21.

In addition, as used materials in the nickel salt solution and the reducing agent solution, reagents made of Wako Pure Chemical Corporation were used, except for 60% hydrazine hydrate.

[Crystallization Step]

Except for using the above each medicament (nickel salt solution and reducing agent solution), and except for pouring nickel salt solution into Teflon coated stainless container with stirring blades and heating it while stirring to be liquid temperature of 65° C., it was performed as well as example 1, and reaction solution (nickel chloride+palladium salt+hydrazine+sodium hydroxide) with liquid temperature of 58° C. was prepared, and crystallization reaction with reaction starting temperature of 58° C. was performed, and after surface treatment, the reaction solution was washed, solid-liquid separated, and dried, and nickel crystal powder was obtained.

With respect to 172.5 g of 60% hydrazine hydrate blended in reducing agent solution, amount of 60% hydrazine hydrate consumed in crystallization reaction was 171 g, and molar ratio with respect to nickel was 1.20. Here, molar ratio of hydrazine consumed in reductive reaction with respect to nickel can be presumed as 0.5 from the formula (3), so it can be estimated that molar ratio of hydrazine consumed by autolysis with respect to nickel was 0.70.

Spiral jet disintegrating treatment as well as example 1 was performed to the nickel crystal powder, and nickel powder relating to example 5, in which minute amount of amine compound (ethylene diamine: EDA) was applied to crystallization reaction of wet process as autolysis inhibitor of hydrazine, was obtained.

Example 6

[Preparation of Nickel Salt Solution]

405 g of nickel chloride hexahydrate ($NiCl_2.6H_2O$, molecular weight: 237.69) as nickel salt, and 2.67 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 10 mass ppm (5.5 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 242 g, and reducing agent solution was prepared, which is aqueous solution containing hydrazine as main component, and not containing alkali hydroxide. Molar ratio of hydrazine contained in reducing agent solution with respect to nickel was 1.70.

In addition, as used materials in the nickel salt solution and the reducing agent solution, reagents made of Wako Pure Chemical Corporation were used, except for 60% hydrazine hydrate.

[Crystallization Step]

Except for using the above each medicament (nickel salt solution and reducing agent solution), and except for pouring nickel salt solution into Teflon coated stainless container with stirring blades and heating it while stirring to be liquid temperature of 85° C., it was performed as well as example 1, and reaction solution (nickel chloride+palladium salt+hydrazine+sodium hydroxide) with liquid temperature of 70° C. was prepared, and crystallization reaction with reaction starting temperature of 70° C. was performed, and after surface treatment, the reaction solution was washed, solid-liquid separated, and dried, and nickel crystal powder was obtained.

With respect to 242 g of 60% hydrazine hydrate blended in reducing agent solution, amount of 60% hydrazine hydrate consumed in crystallization reaction was 240 g, and molar ratio with respect to nickel was 1.69. Here, molar ratio of hydrazine consumed in reductive reaction with respect to nickel can be presumed as 0.5 from the formula (3), so it can be estimated that molar ratio of hydrazine consumed by autolysis with respect to nickel was 1.19.

Spiral jet disintegrating treatment as well as example 1 was performed to the nickel crystal powder, and nickel powder relating to example 6, in which minute amount of amine compound (ethylene diamine: EDA) was applied to crystallization reaction of wet process as autolysis inhibitor of hydrazine, was obtained.

Example 7

[Preparation of Nickel Salt Solution]

405 g of nickel chloride hexahydrate ($NiCl_2.6H_2O$, molecular weight: 237.69) as nickel salt, and 26.72 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 100 mass ppm (55.3 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 225 g, and reducing agent solution was prepared, which is aqueous solution containing hydrazine as main component, and not containing alkali hydroxide. Molar ratio of hydrazine contained in reducing agent solution with respect to nickel was 1.58.

[Amine Compound Solution]

1.024 g of ethylene diamine (EDA) ($H_2NC_2H_4NH_2$, molecular weight: 60.1) which is alkylene amine containing two primary amino groups (—$NH_2$) in molecule as amine compound as autolysis inhibitor and accelerator of reductive reaction (complexing agent) was dissolved in 20 mL of pure water, and amine compound solution was prepared, which is aqueous solution containing ethylene diamine as main component. Molar ratio of ethylene diamine contained in amine compound solution with respect to nickel was 0.01 (1.0 mol %), and it was minute amount.

In addition, as used materials in the nickel salt solution, the reducing agent solution, and the amine compound solution, reagents made of Wako Pure Chemical Corporation were used, except for 60% hydrazine hydrate.

[Crystallization Step]

Except for using the above each medicament (nickel salt solution, reducing agent solution and amine compound solution), crystallization reaction with reaction starting temperature of 63° C. was performed as well as example 1, and after surface treatment, the reaction solution was washed, solid-liquid separated, and dried, and nickel crystal powder was obtained.

With respect to 225 g of 60% hydrazine hydrate blended in reducing agent solution, amount of 60% hydrazine hydrate consumed in crystallization reaction was 208 g, and molar ratio with respect to nickel was 1.46. Here, molar ratio of hydrazine consumed in reductive reaction with respect to nickel can be presumed as 0.5 from the formula (3), so it can be estimated that molar ratio of hydrazine consumed by autolysis with respect to nickel was 0.96.

Spiral jet disintegrating treatment as well as example 1 was performed to the nickel crystal powder, and nickel powder relating to example 7, in which minute amount of amine compound (ethylene diamine: EDA) was applied to crystallization reaction of wet process as autolysis inhibitor of hydrazine, was obtained.

Example 8

[Preparation of Nickel Salt Solution]

405 g of nickel chloride hexahydrate ($NiCl_2.6H_2O$, molecular weight: 237.69) as nickel salt, and 13.36 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt and nucleating agent which is metal salt of metal more noble than nickel as main components. Here, in nickel salt solution, palladium (Pd) was 50 mass ppm (27.6 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 210 g, and reducing agent solution was prepared, which is aqueous solution containing hydrazine as main component, and not containing alkali hydroxide. Molar ratio of hydrazine contained in reducing agent solution with respect to nickel was 1.48.

[Amine Compound Solution]

1.024 g of ethylene diamine (EDA) ($H_2NC_2H_4NH_2$, molecular weight: 60.1) which is alkylene amine containing two primary amino groups (—$NH_2$) in molecule as amine compound as autolysis inhibitor and accelerator of reductive reaction (complexing agent) was dissolved in 20 mL of pure water, and amine compound solution was prepared, which is aqueous solution containing ethylene diamine as main component. Molar ratio of ethylene diamine contained in amine compound solution with respect to nickel was 0.01 (1.0 mol %), and it was minute amount.

In addition, as used materials in the nickel salt solution, the reducing agent solution, and the amine compound solution, reagents made of Wako Pure Chemical Corporation were used, except for 60% hydrazine hydrate.

[Crystallization Step]

Except for using the above each medicament (nickel salt solution, reducing agent solution and amine compound solution), and except for pouring nickel salt solution into Teflon coated stainless container with stirring blades and heating it while stirring to be liquid temperature of 55° C., and except for heating alkali hydroxide solution before mixing to liquid temperature of 70° C., it was performed as well as example 1, and reaction solution (nickel chloride+palladium salt+hydrazine+sodium hydroxide) with liquid temperature of 60° C. was prepared, and crystallization reaction with reaction starting temperature of 60° C. was performed, and after surface treatment, the reaction solution was washed, solid-liquid separated, and dried, and nickel crystal powder was obtained.

With respect to 210 g of 60% hydrazine hydrate blended in reducing agent solution, amount of 60% hydrazine hydrate consumed in crystallization reaction was 203 g, and molar ratio with respect to nickel was 1.43. Here, molar ratio of hydrazine consumed in reductive reaction with respect to nickel can be presumed as 0.5 from the formula (3), so it can be estimated that molar ratio of hydrazine consumed by autolysis with respect to nickel was 0.93.

Spiral jet disintegrating treatment as well as example 1 was performed to the nickel crystal powder, and nickel powder relating to example 8, in which minute amount of amine compound (ethylene diamine: EDA) was applied to crystallization reaction of wet process as autolysis inhibitor of hydrazine, was obtained.

Example 9

[Preparation of Nickel Salt Solution]

405 g of nickel chloride hexahydrate ($NiCl_2.6H_2O$, molecular weight: 237.69) as nickel salt, 2.542 g of L-methionine ($CH_3SC_2H_4CH(NH_2)COOH$, molecular weight: 149.21) containing one sulfide group (—S—) in molecule as sulfide compound as autolysis inhibition adjuvant and 0.134 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt, sulfide compound and nucleating agent which is metal salt of metal more noble than nickel as main components. Here, in nickel salt solution, molar ratio of L-methionine which is sulfide compound with respect to nickel was 0.01 (1.0 mol %), and it was minute amount, and palladium (Pd) was 0.5 mass ppm (0.28 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 138 g, and reducing agent solution was prepared, which is aqueous solution containing hydrazine as main component, and not containing alkali hydroxide. Molar ratio of hydrazine contained in reducing agent solution with respect to nickel was 0.97.

[Alkali Hydroxide Solution]

276 g of sodium hydroxide (NaOH, molecular weight: 40.0) as alkali hydroxide was dissolved in 672 mL of pure water, and alkali hydroxide solution was prepared, which is aqueous solution containing sodium hydroxide as main component. Molar ratio of sodium hydroxide contained in alkali hydroxide solution with respect to nickel was 6.90.

[Amine Compound Solution]

1.024 g of ethylene diamine (EDA) ($H_2NC_2H_4NH_2$, molecular weight: 60.1) which is alkylene amine containing two primary amino groups (—$NH_2$) in molecule as amine compound as autolysis inhibitor and accelerator of reductive reaction (complexing agent) was dissolved in 19 mL of pure water, and amine compound solution was prepared, which is aqueous solution containing ethylene diamine as main component. Molar ratio of ethylene diamine contained in amine compound solution with respect to nickel was 0.01 (1.0 mol %), and it was minute amount.

In addition, as used materials in the nickel salt solution, the reducing agent solution, the alkali hydroxide solution and the amine compound solution, reagents made of Wako Pure Chemical Corporation were used, except for 60% hydrazine hydrate.

[Crystallization Step]

Except for using the above each medicament (nickel salt solution, reducing agent solution, alkali hydroxide solution and amine compound solution), and except for pouring nickel salt solution into Teflon coated stainless container with stirring blades and heating it while stirring to be liquid temperature of 85° C., it was performed as well as example 1, and reaction solution (nickel chloride+methionine+palladium salt+hydrazine+sodium hydroxide) with liquid temperature of 70° C. was prepared, and crystallization reaction with reaction starting temperature of 70° C. was performed, and after surface treatment, the reaction solution was washed, solid-liquid separated, and dried, and nickel crystal powder was obtained.

With respect to 138 g of 60% hydrazine hydrate blended in reducing agent solution, amount of 60% hydrazine hydrate consumed in crystallization reaction was 131 g, and molar ratio with respect to nickel was 0.92. Here, molar ratio of hydrazine consumed in reductive reaction with respect to nickel can be presumed as 0.5 from the formula (3), so it can be estimated that molar ratio of hydrazine consumed by autolysis with respect to nickel was 0.42.

Spiral jet disintegrating treatment as well as example 1 was performed to the nickel crystal powder, and nickel powder relating to example 9, in which minute amount of amine compound (ethylene diamine: EDA) was applied to crystallization reaction of wet process as autolysis inhibitor of hydrazine, and in which minute amount of sulfide compound (methionine) was applied to crystallization reaction of wet process as autolysis inhibition adjuvant of hydrazine, was obtained.

Example 10

[Preparation of Nickel Salt Solution]

405 g of nickel chloride hexahydrate ($NiCl_2.6H_2O$, molecular weight: 237.69) as nickel salt, 1.271 g of L-methionine ($CH_3SC_2H_4CH(NH_2)COOH$, molecular weight: 149.21) containing one sulfide group (—S—) in molecule as sulfide compound as autolysis inhibition adjuvant, and 0.134 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt, sulfide compound and nucleating agent which is metal salt of metal more noble than nickel as main components. Here, in nickel salt solution, molar ratio of L-methionine which is sulfide compound with respect to nickel was 0.005 (0.5 mol %), and it was minute amount, and palladium (Pd) was 0.5 mass ppm (0.28 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 135 g, and reducing agent solution was prepared, which is aqueous solution containing hydrazine as main component, and not containing alkali hydroxide. Molar ratio of hydrazine contained in reducing agent solution with respect to nickel was 0.95.

[Alkali Hydroxide Solution]

276 g of sodium hydroxide (NaOH, molecular weight: 40.0) as alkali hydroxide was dissolved in 672 mL of pure water, and alkali hydroxide solution was prepared, which is aqueous solution containing sodium hydroxide as main component. Molar ratio of sodium hydroxide contained in alkali hydroxide solution with respect to nickel was 6.90.

[Amine Compound Solution]

0.088 g of diethylene triamine (DETA) ($H_2NC_2H_4NHC_2H_4NH_2$, molecular weight: 103.17) which is alkylene amine containing two primary amino groups (—$NH_2$), and also, one secondary amino group (—NH—) in molecule as amine compound as autolysis inhibitor and accelerator of reductive reaction (complexing agent) was dissolved in 20 mL of pure water, and amine compound solution was prepared, which is aqueous solution containing diethylene triamine as main component. Molar ratio of diethylene triamine contained in amine compound solution with respect to nickel was 0.0005 (0.05 mol %), and it was infinitesimal amount.

In addition, as used materials in the nickel salt solution, the reducing agent solution, the alkali hydroxide solution and the amine compound solution, reagents made of Wako Pure Chemical Corporation were used, except for 60% hydrazine hydrate.

[Crystallization Step]

Except for using the above each medicament (nickel salt solution, reducing agent solution, alkali hydroxide solution and amine compound solution), and except for pouring nickel salt solution into Teflon coated stainless container with stirring blades and heating it while stirring to be liquid temperature of 85° C., it was performed as well as example 1, and reaction solution (nickel chloride+methionine+palladium salt+hydrazine+sodium hydroxide) with liquid temperature of 70° C. was prepared, and crystallization reaction with reaction starting temperature of 70° C. was performed, and after surface treatment, the reaction solution was washed, solid-liquid separated, and dried, and nickel crystal powder was obtained.

With respect to 135 g of 60% hydrazine hydrate blended in reducing agent solution, amount of 60% hydrazine hydrate consumed in crystallization reaction was 131 g, and molar ratio with respect to nickel was 0.92. Here, molar ratio of hydrazine consumed in reductive reaction with respect to nickel can be presumed as 0.5 from the formula (3), so it can be estimated that molar ratio of hydrazine consumed by autolysis with respect to nickel was 0.42.

Spiral jet disintegrating treatment as well as example 1 was performed to the nickel crystal powder, and nickel powder relating to example 10, in which minute amount of amine compound (diethylene triamine: DETA) was applied to crystallization reaction of wet process as autolysis inhibitor of hydrazine, and in which minute amount of sulfide compound (methionine) was applied to crystallization reaction of wet process as autolysis inhibition adjuvant of hydrazine, was obtained.

Example 11

[Preparation of Nickel Salt Solution]

405 g of nickel chloride hexahydrate ($NiCl_2.6H_2O$, molecular weight: 237.69) as nickel salt, 0.768 g of thiodiglycolic acid (2, 2'-thiodiglycolic acid, 2, 2'-thiodiacetic acid) ($HOOCCH_2SCH_2COOH$, molecular weight: 150.15) containing one sulfide group (—S—) in molecule as sulfide compound as autolysis inhibition adjuvant, and 0.027 mg of palladium (11) chloride ammonium (tetrachloropalladium (II) ammonium dihydrate) ($(NH_4)_2PdCl_4$, molecular weight: 284.31) as metal salt of metal more noble than nickel, were dissolved in 1880 mL of pure water, and nickel salt solution was prepared, which is aqueous solution containing nickel salt, sulfide compound and nucleating agent which is metal salt of metal more noble than nickel as main components. Here, in nickel salt solution, molar ratio of thiodiglycolic acid which is sulfide compound with respect to nickel was 0.003 (0.3 mol %), and it was minute amount, and palladium (Pd) was 0.1 mass ppm (0.06 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 138 g, and reducing agent solution was prepared, which is aqueous solution containing hydrazine as main component, and not containing alkali hydroxide. Molar ratio of hydrazine contained in reducing agent solution with respect to nickel was 0.97.

[Alkali Hydroxide Solution]

276 g of sodium hydroxide (NaOH, molecular weight: 40.0) as alkali hydroxide was dissolved in 672 mL of pure water, and alkali hydroxide solution was prepared, which is aqueous solution containing sodium hydroxide as main component. Molar ratio of sodium hydroxide contained in alkali hydroxide solution with respect to nickel was 6.90.

[Amine Compound Solution]

1.024 g of ethylene diamine (EDA) ($H_2NC_2H_4NH_2$, molecular weight: 60.1) which is alkylene amine containing two primary amino groups (—$NH_2$) in molecule as amine compound as autolysis inhibitor and accelerator of reductive reaction (complexing agent) was dissolved in 19 mL of pure water, and amine compound solution was prepared, which is aqueous solution containing ethylene diamine as main component. Molar ratio of ethylene diamine contained in amine compound solution with respect to nickel was 0.01 (1.0 mol %), and it was minute amount.

In addition, as used materials in the nickel salt solution, the reducing agent solution, the alkali hydroxide solution and the amine compound solution, reagents made of Wako Pure Chemical Corporation were used, except for 60% hydrazine hydrate.

[Crystallization Step]

Except for using the above each medicament (nickel salt solution, reducing agent solution, alkali hydroxide solution and amine compound solution), and except for pouring nickel salt solution into Teflon coated stainless container with stirring blades and heating it while stirring to be liquid temperature of 85° C., it was performed as well as example 1, and reaction solution (nickel chloride+thiodiglycolic acid+palladium salt+hydrazine+sodium hydroxide) with liquid temperature of 70° C. was prepared, and crystallization reaction with reaction starting temperature of 70° C. was performed, and after surface treatment, the reaction solution was washed, solid-liquid separated, and dried, and nickel crystal powder was obtained.

With respect to 138 g of 60% hydrazine hydrate blended in reducing agent solution, amount of 60% hydrazine hydrate consumed in crystallization reaction was 123 g, and molar ratio with respect to nickel was 0.87. Here, molar ratio of hydrazine consumed in reductive reaction with respect to nickel can be presumed as 0.5 from the formula (3), so it can be estimated that molar ratio of hydrazine consumed by autolysis with respect to nickel was 0.37.

Spiral jet disintegrating treatment as well as example 1 was performed to the nickel crystal powder, and nickel powder relating to example 11, in which minute amount of amine compound (ethylene diamine: EDA) was applied to crystallization reaction of wet process as autolysis inhibitor of hydrazine, and in which minute amount of sulfide compound (thiodiglycolic acid) was applied to crystallization reaction of wet process as autolysis inhibition adjuvant of hydrazine, was obtained.

Comparative Example 1

Amine compound as autolysis inhibitor and accelerator of reductive reaction (complexing agent) in example 1 was not used, and tartaric acid conventionally used as accelerator of reductive reaction (complexing agent) was applied instead. In other words, it is as follows.

[Preparation of Nickel Salt Solution]

405 g of nickel chloride hexahydrate ($NiCl_2.6H_2O$, molecular weight: 237.69) as nickel salt, 2.14 mg of palladium (II) chloride ammonium (tetrachloropalladium (II) ammonium dihydrate) ($(NH_4)_2PdCl_4$, molecular weight: 284.31) as metal salt of metal more noble than nickel, and 2.56 g of tartaric acid ((HOOC)CH(OH)CH(OH)(COOH), molecular weight: 150.09) as accelerator of reductive reaction (complexing agent), were dissolved in 1780 mL of pure water, and nickel salt solution was prepared, which is aqueous solution containing nickel salt, nucleating agent which is metal salt of metal more noble than nickel, and tartaric acid as accelerator of reductive reaction (complexing agent) as main components. Here, in nickel salt solution, palladium (Pd) was 8.0 mass ppm (4.4 molar ppm) with respect to nickel (Ni). In addition, molar ratio of tartaric acid with respect to nickel (Ni) was 0.01 (1.0 mol %).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 355 g, and reducing agent solution was prepared, which is aqueous solution containing hydrazine as main component, and not containing alkali hydroxide. Molar ratio of hydrazine contained in reducing agent solution with respect to nickel was 2.50.

[Crystallization Step]

Except for using the above each medicament (nickel salt solution and reducing agent solution), and except for not performing addition and mixing (dripping and mixing) of amine compound solution, crystallization reaction with reaction starting temperature of 63° C. was performed as well as example 1, and after surface treatment, the reaction solution was washed, solid-liquid separated, and dried, and nickel crystal powder was obtained.

In addition, in the crystallization reaction with reaction starting temperature of 63° C., autolysis of hydrazine was vigorous, and it was short of supply only by 355 g of 60% hydrazine hydrate blended in reducing agent solution, so in the middle of crystallization reaction, 60% hydrazine hydrate was additionally added and mixed to finish reductive reaction. Amount of 60% hydrazine hydrate finally consumed in crystallization reaction was 360 g, and molar ratio with respect to nickel was 2.53. Here, molar ratio of hydrazine consumed in reductive reaction with respect to nickel can be presumed as 0.5 from the formula (3), so it can be estimated that molar ratio of hydrazine consumed by autolysis with respect to nickel was 2.03.

Spiral jet disintegrating treatment as well as example 1 was performed to the nickel crystal powder, and nickel powder relating to comparative example 1, in which tartaric acid that autolysis inhibiting function of hydrazine cannot be recognized was applied to crystallization reaction of wet process, was obtained.

Comparative Example 2

[Preparation of Nickel Salt Solution]

405 g of nickel chloride hexahydrate ($NiCl_2.6H_2O$, molecular weight: 237.69) as nickel salt, and 1.60 mg of palladium (II) chloride ammonium (tetrachloropalladium (II) ammonium dihydrate) ($(NH_4)_2PdCl_4$, molecular weight: 284.31) as metal salt of metal more noble than nickel, were dissolved in 1780 mL of pure water, and nickel salt solution was prepared, which is aqueous solution containing nickel salt and nucleating agent which is metal salt of metal more noble than nickel as main components. Here, in nickel salt solution, palladium (Pd) was 6.0 mass ppm (3.3 molar ppm) with respect to nickel (Ni).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 355 g, and reducing agent solution was prepared, which is aqueous solution containing hydrazine as main component, and not containing alkali hydroxide. Molar ratio of hydrazine contained in reducing agent solution with respect to nickel was 2.50.

[Crystallization Step]

Except for using the above each medicament (nickel salt solution and reducing agent solution), and except for not using accelerator of reductive reaction (complexing agent), crystallization reaction with reaction starting temperature of 63° C. was performed as well as comparative example 1, but as accelerator of reductive reaction (complexing agent) was not contained at all in reaction solution, rate of reductive reaction was extremely slow, and in the middle of crystallization reaction after 120 minutes from start of reaction (preparation of reaction solution), all of hydrazine were consumed and hydrazine was depleted, so nickel hydroxide which is unreduced reactant was mixed in nickel crystal powder, and it was not possible to obtain normal nickel crystal powder.

All of 355 g of 60% hydrazine hydrate blended in reducing agent solution were consumed in the middle of crystallization reaction, and molar ratio of hydrazine consumed in reductive reaction with respect to nickel can be presumed as 0.5 from the formula (3), so it can be estimated that molar ratio of hydrazine consumed by autolysis until the reductive reaction stopped in the middle by depletion of hydrazine with respect to nickel was 2.0. Therefore, if reductive reaction was finished by adding and mixing 60% hydrazine hydrate, it can be estimated that molar ratio of hydrazine consumed by autolysis with respect to nickel was over 2.0.

As mentioned above, it was not possible to obtain normal nickel crystal powder, so spiral jet disintegrating treatment as well as example 1 was not performed, and nickel powder relating to comparative example 2 was not obtained.

Comparative Example 3

[Preparation of Nickel Salt Solution]

405 g of nickel chloride hexahydrate ($NiCl_2.6H_2O$, molecular weight: 237.69) as nickel salt, 1.60 mg of palladium (II) chloride ammonium (tetrachloropalladium (II) ammonium dihydrate) ($(NH_4)_2PdCl_4$, molecular weight: 284.31) as metal salt of metal more noble than nickel, and 2.56 g of tartaric acid ((HOOC)CH(OH)CH(OH)(COOH), molecular weight: 150.09) as accelerator of reductive reaction (complexing agent), were dissolved in 1780 mL of pure water, and nickel salt solution was prepared, which is aqueous solution containing nickel salt, nucleating agent which is metal salt of metal more noble than nickel, and tartaric acid as accelerator of reductive reaction (complexing agent) as main components. Here, in nickel salt solution, palladium (Pd) was 6.0 mass ppm (3.3 molar ppm) with respect to nickel (Ni). In addition, molar ratio of tartaric acid with respect to nickel (Ni) was 0.01 (1.0 mol %).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 345 g, and reducing agent solution was prepared, which is aqueous solution containing hydrazine as main component, and not containing alkali hydroxide. Molar ratio of hydrazine contained in reducing agent solution with respect to nickel was 2.43.

[Crystallization Step]

Except for using the above each medicament (nickel salt solution and reducing agent solution), and except for not performing addition and mixing (dripping and mixing) of amine compound solution, crystallization reaction with reaction starting temperature of 58° C. was performed as well as example 5, and after surface treatment, the reaction solution was washed, solid-liquid separated, and dried, and nickel crystal powder was obtained.

With respect to 345 g of 60% hydrazine hydrate blended in reducing agent solution, amount of 60% hydrazine hydrate consumed in crystallization reaction was 330 g, and molar ratio with respect to nickel was 2.32. Here, molar ratio of hydrazine consumed in reductive reaction with respect to nickel can be presumed as 0.5 from the formula (3), so it can be estimated that molar ratio of hydrazine consumed by autolysis with respect to nickel was 1.82.

Spiral jet disintegrating treatment as well as example 5 was performed to the nickel crystal powder, and nickel powder relating to comparative example 3, in which tartaric acid that autolysis inhibiting function of hydrazine cannot be recognized was applied to crystallization reaction of wet process, was obtained.

Comparative Example 4

[Preparation of Nickel Salt Solution]

405 g of nickel chloride hexahydrate ($NiCl_2.6H_2O$, molecular weight: 237.69) as nickel salt, 1.60 mg of palladium (II) chloride ammonium (tetrachloropalladium (II) ammonium dihydrate) ($(NH_4)_2PdCl_4$, molecular weight: 284.31) as metal salt of metal more noble than nickel, and 15.34 g of tartaric acid ((HOOC)CH(OH)CH(OH)(COOH), molecular weight: 150.09) as accelerator of reductive reaction (complexing agent), were dissolved in 1780 mL of pure water, and nickel salt solution was prepared, which is aqueous solution containing nickel salt, nucleating agent which is metal salt of metal more noble than nickel, and tartaric acid as accelerator of reductive reaction (complexing agent) as main components. Here, in nickel salt solution, palladium (Pd) was 6.0 mass ppm (3.3 molar ppm) with respect to nickel (Ni). In addition, molar ratio of tartaric acid with respect to nickel (Ni) was 0.06 (6.0 mol %).

[Preparation of Reducing Agent Solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 355 g, and reducing agent solution was prepared, which is aqueous solution containing hydrazine as main component, and not containing alkali hydroxide. Molar ratio of hydrazine contained in reducing agent solution with respect to nickel was 2.50.

[Crystallization Step]

Except for using the above each medicament (nickel salt solution and reducing agent solution), and except for not performing addition and mixing (dripping and mixing) of amine compound solution, crystallization reaction with reaction starting temperature of 70° C. was performed as well as example 6, and after surface treatment, the reaction solution was washed, solid-liquid separated, and dried, and nickel crystal powder was obtained.

In addition, in the crystallization reaction with reaction starting temperature of 70° C., autolysis of hydrazine was vigorous, and it was short of supply only by 355 g of 60% hydrazine hydrate blended in reducing agent solution, so in the middle of crystallization reaction, 60% hydrazine hydrate was additionally added and mixed to finish reductive reaction. Amount of 60% hydrazine hydrate finally consumed in crystallization reaction was 398 g, and molar ratio with respect to nickel was 2.80. Here, molar ratio of hydrazine consumed in reductive reaction with respect to nickel can be presumed as 0.5 from the formula (3), so it can be estimated that molar ratio of hydrazine consumed by autolysis with respect to nickel was 2.30.

Spiral jet disintegrating treatment as well as example 6 was performed to the nickel crystal powder, and nickel powder relating to comparative example 4, in which tartaric acid that autolysis inhibiting function of hydrazine cannot be recognized was applied to crystallization reaction of wet process, was obtained.

Comparative Example 5

[Preparation of Nickel Salt Solution]

405 g of nickel chloride hexahydrate ($NiCl_2.6H_2O$, molecular weight: 237.69) as nickel salt, 2.542 g of L-methionine ($CH_3SC_2H_4CH(NH_2)COOH$, molecular weight: 149.21) containing one sulfide group (—S—) in molecule as sulfide compound as autolysis inhibition adjuvant, 0.080 mg of palladium (II) chloride ammonium (tetrachloropalladium (II) ammonium dihydrate) ($(NH_4)_2PdCl_4$, molecular weight: 284.31) as metal salt of metal more noble than nickel, and 2.56 g of tartaric acid ((HOOC)CH(OH)CH(OH)(COOH), molecular weight: 150.09) as accelerator of reductive reaction (complexing agent), were dissolved in 1780 mL of pure water, and nickel salt solution was prepared, which is aqueous solution containing nickel salt, sulfide compound, nucleating agent which is metal salt of metal more noble than nickel, and tartaric acid as accelerator of reductive reaction (complexing agent) as main components. Here, in nickel salt solution, molar ratio of L-methionine which is sulfide compound with respect to nickel was 0.01 (1.0 mol %) and it was minute amount, and palladium (Pd) was 0.3 mass ppm (0.17 molar ppm) with respect to nickel (Ni). In addition, molar ratio of tartaric acid with respect to nickel (Ni) was 0.01 (1.0 mol %).

[Preparation of reducing agent solution]

Commercially available industrial grade 60% hydrazine hydrate (made of Otsuka-MGC Chemical Company, Inc.) in which hydrazine hydrate ($N_2H_4.H_2O$, molecular weight: 50.06) as reducing agent was diluted to 1.67 times by pure water was weighed of 300 g, and reducing agent solution was prepared, which is aqueous solution containing hydrazine as main component, and not containing alkali hydroxide. Molar ratio of hydrazine contained in reducing agent solution with respect to nickel was 2.11.

[Crystallization Step]

Except for using the above each medicament (nickel salt solution and reducing agent solution), and except for not performing addition and mixing (dripping and mixing) of amine compound solution, crystallization reaction with reaction starting temperature of 70° C. was performed as well as example 6, and after surface treatment, the reaction solution was washed, solid-liquid separated, and dried, and nickel crystal powder was obtained.

With respect to 300 g of 60% hydrazine hydrate blended in reducing agent solution, amount of 60% hydrazine hydrate consumed in crystallization reaction was 286 g, and molar ratio with respect to nickel was 2.01. Here, molar ratio of hydrazine consumed in reductive reaction with respect to nickel can be presumed as 0.5 from the formula (3), so it can be estimated that molar ratio of hydrazine consumed by autolysis with respect to nickel was 1.51.

Spiral jet disintegrating treatment as well as example 6 was performed to the nickel crystal powder, and nickel powder relating to comparative example 5, in which tartaric acid that autolysis inhibiting function of hydrazine cannot be recognized was applied to crystallization reaction of wet process, and in which minute amount of sulfide compound (methionine) was applied to crystallization reaction of wet process as autolysis inhibition adjuvant of hydrazine, was obtained.

Each medicament and crystallization conditions used in crystallization step are illustrated in table 1. In addition, characteristics of obtained nickel powder are illustrated together in table 2.

TABLE 1

| | Nickel salt solution | | | | | |
|---|---|---|---|---|---|---|
| | | Metal salt of | Accelerator of | Sulfide comopund (autolysis inhibition adjuvant of hydrazine) | | Reducing agent solution |
| | Nickel salt | metal more noble than Ni (metal/mass ppm with respect to Ni) | reductive reaction [complexing agent] (mol % with respect to Ni) | Name of substance | Blending quantity of sulfide compound (mol % with respect to Ni) | Blended hydrazine/consumed hydrazine (molar ratio with respect to Ni) |
| Example 1 | $NiCl_2$ | Pd/9.0 | None | — | — | 1.51/1.49 |
| Example 2 | $NiCl_2$ | Pd/6.0 | None | — | — | 1.69/1.60 |
| Example 3 | $NiCl_2$ | Pd/6.0 | Tartaric acid/0.50 | — | — | 1.69/1.67 |
| Example 4 | $NiCl_2$ | Pd/8.0 | None | — | — | 1.58/1.55 |
| Example 5 | $NiCl_2$ | Pd/6.0 | None | — | — | 1.21/1.20 |
| Example 6 | $NiCl_2$ | Pd/10.0 | None | — | — | 1.70/1.69 |
| Example 7 | $NiCl_2$ | Pd/100 | None | — | — | 1.58/1.46 |
| Example 8 | $NiCl_2$ | Pd/50 | None | — | — | 1.48/1.43 |
| Example 9 | $NiCl_2$ | Pd/0.5 | None | Methionine | 1.0 | 0.97/0.92 |
| Example 10 | $NiCl_2$ | Pd/0.5 | None | Methionine | 0.5 | 0.95/0.92 |
| Example 11 | $NiCl_2$ | Pd/0.1 | None | Thiodiglycolic acid | 0.3 | 0.97/0.87 |

TABLE 1-continued

| | | | | | | |
|---|---|---|---|---|---|---|
| Comparative example 1 | $NiCl_2$ | Pd/8.0 | Tartaric acid/ 1.00 | — | 0 | 2.53 (Note1)/2.53 |
| Comparative example 2 | $NiCl_2$ | Pd/6.0 | None | — | 0 | 2.50/2.50 (Note2) |
| Comparative example 3 | $NiCl_2$ | Pd/6.0 | Tartaric acid/ 1.00 | — | 0 | 2.43/2.32 |
| Comparative example 4 | $NiCl_2$ | Pd/6.0 | Tartaric acid/ 6.00 | — | 0 | 2.80 (Note3)/2.80 |
| Comparative example 5 | $NiCl_2$ | Pd/0.3 | Tartaric acid/ 1.00 | Methionine | 1.0 | 2.11/2.01 |

| | | Amine compound (autolysis inhibitor of hydrazine, accelerator of reductive reaction, coupling inhibitor) | | | Reaction |
|---|---|---|---|---|---|
| | Alkali hydroxide solution Alkali hydroxide (molar ratio with respect to Ni) | Name of substance | Number of amino groups contained in molecule | Blending quantity of amine compound (mol % with respect to Ni) | solution Reaction starting temperature (° C.) |
| Example 1 | NaOH/5.75 | EDA | Primary × 2 | 2.0 | 63 |
| Example 2 | NaOH/5.75 | DETA | Primary × 2 + secondary × 1 | 0.05 | 63 |
| Example 3 | NaOH/5.75 | TAEA | Primary × 3 | 0.05 | 63 |
| Example 4 | NaOH/5.75 | AEEA | Primary × 1 + secondary × 1 | 1.0 | 63 |
| Example 5 | NaOH/5.75 | EDA | Primary × 2 | 2.0 | 58 |
| Example 6 | NaOH/5.75 | EDA | Primary × 2 | 2.0 | 70 |
| Example 7 | NaOH/5.75 | EDA | Primary × 2 | 1.0 | 63 |
| Example 8 | NaOH/5.75 | EDA | Primary × 2 | 1.0 | 60 |
| Example 9 | NaOH/6.90 | EDA | Primary × 2 | 1.0 | 70 |
| Example 10 | NaOH/6.90 | DETA | Primary × 2 + secondary × 1 | 0.05 | 70 |
| Example 11 | NaOH/6.90 | EDA | Primary × 2 | 1.0 | 70 |
| Comparative example 1 | NaOH/5.75 | — | — | 0 | 63 |
| Comparative example 2 | NaOH/5.75 | — | — | 0 | 63 |
| Comparative example 3 | NaOH/5.75 | — | — | 0 | 58 |
| Comparative example 4 | NaOH/5.75 | — | — | 0 | 70 |
| Comparative example 5 | NaOH/5.75 | — | — | 0 | 70 |

(Note 1, Note 3): Initially blended hydrazine (molar ratio with respect to Ni 2.50) will be in short supply, so blending quantity of hydrazine is sum of initially blended and added hydrazine
(Note 2): All of initially blended hydrazine (molar ratio with respect to Ni 2.50) will be consumed and hydrazine will be depleted, so reductive reaction will be stopped in the middle

TABLE 2

| | Average | Content in nickel powder (mass %) | | | Crystallite diameter (before | |
|---|---|---|---|---|---|---|
| | particle size (μm) | Chlorine (Cl) | Sodium (Na) | Sulfur (S) | disintegrating step) (nm) | Content of coarse particles (%) |
| Example 1 | 0.27 | <0.001 | 0.002 | 0.17 | 31.7 | 0.05 |
| Example 2 | 0.30 | <0.001 | 0.002 | 0.15 | 31.2 | 0.08 |
| Example 3 | 0.30 | <0.001 | 0.002 | 0.16 | 31.0 | 0.08 |
| Example 4 | 0.27 | <0.001 | 0.002 | 0.17 | 32.0 | 0.06 |
| Example 5 | 0.30 | 0.002 | 0.003 | 0.15 | 30.1 | 0.09 |
| Example 6 | 0.30 | 0.002 | 0.002 | 0.14 | 34.2 | 0.08 |
| Example 7 | 0.16 | <0.001 | 0.002 | 0.25 | 29.2 | <0.01 |
| Example 8 | 0.13 | 0.003 | 0.003 | 0.28 | 24.9 | <0.01 |
| Example 9 | 0.26 | 0.001 | 0.004 | 0.18 | 30.2 | 0.01 |
| Example 10 | 0.28 | 0.001 | 0.002 | 0.17 | 30.9 | 0.02 |
| Example 11 | 0.26 | <0.001 | 0.002 | 0.17 | 30.7 | 0.01 |
| Comparative example 1 | 0.27 | 0.002 | 0.006 | 0.17 | 30.4 | 1.2 |
| Comparative example 2 | — | — | — | — | — | — |
| Comparative example 3 | 0.25 | 0.003 | 0.008 | 0.18 | 28.8 | 1.6 |

TABLE 2-continued

| | Average particle size (μm) | Content in nickel powder (mass %) Chlorine (Cl) | Sodium (Na) | Sulfur (S) | Crystallite diameter (before disintegrating step) (nm) | Content of coarse particles (%) |
|---|---|---|---|---|---|---|
| Comparative example 4 | 0.27 | 0.001 | 0.006 | 0.18 | 33.2 | 2.1 |
| Comparative example 5 | 0.26 | 0.001 | 0.006 | 0.17 | 30.3 | 0.3 |

When comparing process for producing nickel powder of examples 1 to 4 and 7 with comparative examples 1 and 2, they all comprise crystallization step for obtaining nickel crystal powder with reaction starting temperature of 63° C., but in examples 1 to 4 and 7 using amine compound having both functions of autolysis inhibitor of hydrazine and accelerator of reductive reaction (complexing agent), molar ratio of consumed amount of hydrazine with respect to nickel (Ni) was low as 1.46 to 1.67 (reduction: 0.5, autolysis: 0.96 to 1.17), and autolysis of hydrazine was inhibited, on the other hand, in comparative example 1 using tartaric acid which is only having a function of accelerator of reductive reaction (complexing agent), molar ratio of consumed amount of hydrazine with respect to nickel was extremely high as 2.53 (reduction: 0.5, autolysis: 2.03), and it can be understood that autolysis of hydrazine has been progressed significantly. In addition, in conventional comparative example 2 not using both amine compound and complexing agent, as accelerator of reductive reaction (complexing agent) did not exist, rate of reductive reaction became extremely slow, and hydrazine was consumed significantly as autolysis of hydrazine progressed over long time, so although a lot of hydrazine has been blended, hydrazine depleted before the end of reductive reaction and crystallization reaction did not complete.

When comparing process for producing nickel powder of example 5 with comparative example 3, they all comprise crystallization step for obtaining nickel crystal powder with reaction starting temperature of 58° C., but in example 5 using amine compound (ethylene diamine) having both functions of autolysis inhibitor of hydrazine and accelerator of reductive reaction (complexing agent), molar ratio of consumed amount of hydrazine with respect to nickel (Ni) was low as 1.20 (reduction: 0.5, autolysis: 0.70), and autolysis of hydrazine was inhibited, on the other hand, in comparative example 3 using tartaric acid which is only having a function of accelerator of reductive reaction (complexing agent), molar ratio of consumed amount of hydrazine with respect to nickel was extremely high as 2.32 (reduction: 0.5, autolysis: 1.82), and it can be understood that autolysis of hydrazine has been progressed significantly.

When comparing process for producing nickel powder of examples 6 and 9 to 11 with comparative examples 4 and 5, they all comprise crystallization step for obtaining nickel crystal powder with reaction starting temperature of 70° C., but in example 6 using amine compound (ethylene diamine) having both functions of autolysis inhibitor of hydrazine and accelerator of reductive reaction (complexing agent), molar ratio of consumed amount of hydrazine with respect to nickel (Ni) was low as 1.69 (reduction: 0.5, autolysis: 1.19), and autolysis of hydrazine was inhibited, especially in examples 9 to 11 using sulfide compound (methionine, thiodiglycolic acid) having a function of autolysis inhibition adjuvant of hydrazine, in addition to the amine compound having both functions of autolysis inhibitor of hydrazine and accelerator of reductive reaction (complexing agent), molar ratio of consumed amount of hydrazine with respect to nickel (Ni) was extremely low as 0.87 to 0.92 (reduction: 0.5, autolysis: 0.37 to 0.42), and autolysis of hydrazine was inhibited significantly. On the other hand, in comparative example 4 using tartaric acid which is only having a function of accelerator of reductive reaction (complexing agent), molar ratio of consumed amount of hydrazine with respect to nickel was extremely high as 2.80 (reduction: 0.5, autolysis: 2.30), and it can be understood that autolysis of hydrazine has been progressed significantly. In addition, in comparative example 5 using sulfide compound (methionine) having a function of autolysis inhibition adjuvant of hydrazine, in addition to tartaric acid which is only having a function of accelerator of reductive reaction (complexing agent), molar ratio of consumed amount of hydrazine with respect to nickel was 2.01 (reduction: 0.5, autolysis: 1.51), and autolysis of hydrazine was inhibited more than the comparative example 4 using tartaric acid, but when compared with the example 6 using amine compound (ethylene diamine), or with examples 9 to 11 using amine compound together with sulfide compound, it can be understood that autolysis of hydrazine has been progressed more.

In examples 7 and 8, average particle size will be 0.16 μm and 0.13 μm respectively, and average particle size became smaller value than which of comparative examples. Chlorine concentration in examples 1 to 4, 7 and 11 became less than 0.001%, and it was smaller value than which of comparative examples. In all examples, sulfur content was 1% or less. Crystallite diameter in examples 1 to 6 and 9 to 11 was 30 nm or more. Content of coarse particles in all examples was 0.1% or less, and in examples 1 and 10, it was 0.05% or less, and further, in examples 7 to 9 and 11, it was 0.01% or less.

As mentioned above, although it is the process for producing nickel powder by wet process using hydrazine as reducing agent, it was possible to inhibit autolysis reaction of hydrazine significantly by using infinitesimal amount of specific amine compound or specific amine compound and sulfide compound as autolysis inhibitor of hydrazine. Further, the specific amine compound and sulfide compound also functions as coupling inhibitor which tends to prevent formation of coarse particles generated by coupling of nickel particles themselves, so it was possible to produce high-performance nickel powder suitable for the internal electrode of the laminated ceramic capacitor inexpensively.

In addition, it was explained in detail about each embodiment and each example of the present invention as the above, but it is easy for those who skilled in the art to understand that various modifications are possible without substantially departing from new matters and effects of the present invention. Therefore, all of such modified examples are included within the scope of the present invention.

For example, a term used at least once in the description or drawings together with a different term that is broader or the same in meaning can also be replaced by the different term in any place in the description or drawings. Further, the configurations and operations of the process for producing nickel powder are not limited to those described in each embodiment and each example of the present invention but may be carried out in various modifications.

The invention claimed is:

1. A process for producing nickel powder, comprising a crystallization step including obtaining nickel crystal powder formed by a reductive reaction in a reaction solution in which at least a water-soluble nickel salt, a metal salt of a metal more noble than nickel, hydrazine ($N_2H_4$), an alkali hydroxide, an amine compound, a sulfide compound, and water are mixed, wherein:

the amine compound is an autolysis inhibitor of the hydrazine, the amine compound contains two or more primary amino groups (—$NH_2$) in the molecule, or contains one primary amino group (—$NH_2$) and one or more secondary amino groups (—NH—) in the molecule, a ratio of a molar number of the amine compound with respect to a molar number of nickel in the reaction solution is in a range of from 0.01 mol % to 5 mol %, the sulfide compound is an autolysis inhibition adjuvant of the hydrazine, the sulfide compound contains one or more sulfide group (—S—) in the molecule, and a ratio of a molar number of the sulfide compound with respect to the molar number of the nickel in the reaction solution is in a range of from 0.01 mol % to 5 mol %.

2. The process for producing nickel powder according to claim 1, wherein the amine compound is at least one of an alkylene amine and an alkylene amine derivative.

3. The process for producing nickel powder according to claim 2, wherein the alkylene amine or the alkylene amine derivative is at least one compound having a structure represented by formula A, in which nitrogen atoms of the amino group in the molecule are bonded via a carbon chain with two carbons

A

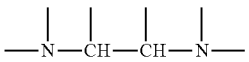

4. The process for producing nickel powder according to claim 3, wherein the alkylene amine is one or more selected from the group consisting of ethylene diamine ($H_2NC_2H_4NH_2$), diethylene triamine ($H_2NC_2H_4NHC_2H_4NH_2$), triethylene tetramine ($H_2N(C_2H_4NH)_2C_2H_4NH_2$), tetraethylene pentamine ($H_2N(C_2H_4NH)_3C_2H_4NH_2$), pentaethylene hexamine ($H_2N(C_2H_4NH)_4C_2H_4NH_2$), and propylene diamine ($CH_3CH(NH_2)CH_2NH_2$), and the alkylene amine derivative is one or more selected from the group consisting of tris (2-aminoethyl) amine ($N(C_2H_4NH_2)_3$), N-(2-aminoethyl) ethanol amine ($H_2NC_2H_4NHC_2H_4OH$), N-(2-aminoethyl) propanol amine ($H_2NC_2H_4NHC_3H_6OH$), 2, 3-diaminopropionic acid ($H_2NCH_2CH(NH)COOH$), and 1, 2-cyclohexane diamine ($H_2NC_6H_{10}NH_2$).

5. The process for producing nickel powder according to claim 1, wherein the sulfide compound is a carboxy group-containing sulfide compound or a hydroxyl group-containing sulfide compound further containing at least one or more carboxy group (—COOH) or hydroxyl group (—OH) in the molecule.

6. The process for producing nickel powder according to claim 5, wherein the carboxy group-containing sulfide compound or the hydroxyl group-containing sulfide compound is one or more selected from the group consisting of methionine ($CH_3SC_2H_4CH(NH_2)COOH$), ethionine ($C_2H_5SC_2H_4CH(NH_2)COOH$), thiodipropionic acid ($HOOCC_2H_4SC_2H_4COOH$), thiodiglycolic acid ($HOOCCH_2SCH_2COOH$), and thiodiglycol ($HOC_2H_5SC_2H_5OH$).

7. The process for producing nickel powder according to claim 1, wherein a ratio of a used amount of a molar number of the hydrazine with respect to the molar number of the nickel is less than 2.0, in the crystallization step.

8. The process for producing nickel powder according to claim 1, wherein a ratio of a used amount of a molar number of the hydrazine with respect to the molar number of the nickel is less than 1.3, in the crystallization step.

9. The process for producing nickel powder according to claim 1, wherein the water-soluble nickel salt is one or more selected from the group consisting of nickel chloride ($NiCl_2$), nickel sulfate ($NiSO_4$), and nickel nitrate ($Ni(NO_3)_2$).

10. The process for producing nickel powder according to claim 1, wherein the metal salt of metal more noble than nickel is one or more selected from the group consisting of a copper salt, a gold salt, a silver salt, a platinum salt, a palladium salt, a rhodium salt, and an iridium salt.

11. The process for producing nickel powder according to claim 1, wherein the alkali hydroxide is one or more selected from the group consisting of sodium hydroxide (NaOH) and potassium hydroxide (KOH).

12. The process for producing nickel powder according to claim 1, wherein the crystallization step further includes:

(i) preparing:

(1) a nickel salt solution by dissolving at least the water soluble nickel salt and the metal salt of metal more noble than nickel in water, and (2) a reducing agent solution by mixing at least the reducing agent, the alkali hydroxide, and water, (ii) adding the amine compound to at least one of the nickel salt solution and the reducing agent solution, (iii) adding the sulfide compound to at least one of the nickel salt solution and the reducing agent solution, and then (iv) mixing the nickel salt solution and the reducing agent solution.

13. The process for producing nickel powder according to claim 1, wherein the crystallization step further includes:

(i) preparing:

(1) a nickel salt solution by dissolving at least the water soluble nickel salt and the metal salt of metal more noble than nickel in water, and (2) a reducing agent solution by mixing at least the reducing agent, the alkali hydroxide, and water, (ii) mixing the nickel salt solution and the reducing agent solution to form a first mixture, and then (iii) mixing the first mixture and the amine compound to form a second mixture, and (iv) mixing the second mixture and the sulfide compound.

14. The process for producing nickel powder according to claim 1, wherein the crystallization further includes:

(i) preparing:

(1) a nickel salt solution by dissolving at least the water soluble nickel salt and the metal salt of metal more noble than nickel in water, and (2) a reducing agent solution by mixing at least the reducing agent, the alkali hydroxide, and (ii) adding the sulfide compound to at least one of the nickel salt solution and the reducing agent solution, followed by (iii) mixing the nickel salt solution and the reducing agent solution to form a mixture, and then (iv) mixing the mixture and the amine compound.

15. The process for producing nickel powder according to claim 1, wherein the crystallization step further includes:

(i) preparing:

(1) a nickel salt solution by dissolving at least the water soluble nickel salt and the metal salt of metal more noble than nickel in water, (2) a reducing agent solution by mixing at least the reducing agent and water, and (3) an alkali hydroxide solution by mixing at least the alkali hydroxide and water, are prepared, (ii) adding the amine compound to at least one of the nickel salt solution, the reducing agent solution, and the alkali hydroxide solution, (iii) adding the sulfide compound to at least one of the nickel salt solution, the reducing agent solution, and the alkali hydroxide solution, and then (iv) mixing the nickel salt solution and the reducing agent solution to obtain a nickel salt/reducing agent-containing solution, and (v) mixing the alkali hydroxide solution and the nickel salt/reducing agent-containing solution.

16. The process for producing nickel powder according to claim 1, wherein the crystallization step further includes:

(i) preparing:

(1) a nickel salt solution by dissolving at least the water soluble nickel salt and the metal salt of metal more noble than nickel in water, (2) a reducing agent solution by mixing at least the reducing agent and water, and (3) an alkali hydroxide solution by mixing at least the alkali hydroxide and water, (ii) mixing the nickel salt solution and the reducing agent solution to obtain a nickel salt/reducing agent-containing solution (iii) mixing the alkali hydroxide solution and the nickel salt/reducing agent-containing solution to form a first mixture, (iv) mixing the first mixture with the amine compound to form a second mixture, and (v) mixing the second mixture with the sulfide compound.

17. The process for producing nickel powder according to claim 1, wherein the crystallization step further includes:

(i) preparing:

(1) a nickel salt solution by dissolving at least the water soluble nickel salt and the metal salt of metal more noble than nickel in water, (2) a reducing agent solution by mixing at least the reducing agent and water, and (3) an alkali hydroxide solution by mixing at least the alkali hydroxide and water, (ii) adding the sulfide compound to at least one of the nickel salt solution, the reducing agent solution, and the alkali hydroxide solution, followed by (iii) mixing the nickel salt solution and the reducing agent solution to obtain a nickel salt/reducing agent-containing solution, (iv) mixing the alkali hydroxide solution and the nickel salt/reducing agent-containing solution to form a mixture, and (v) mixing the mixture and the amine compound.

18. The process for producing nickel powder according to claim 1, wherein in the crystallization step, a temperature of the reaction solution when the reductive reaction starts (reaction starting temperature) is in a range of from 40° C. to 90° C.

* * * * *